US012305410B2

(12) United States Patent
Schmid

(10) Patent No.: US 12,305,410 B2
(45) Date of Patent: May 20, 2025

(54) STRIKING ELEMENT AND METHOD

(71) Applicant: PERI SE, Weissenhorn (DE)

(72) Inventor: Josef Schmid, Balzheim (DE)

(73) Assignee: PERI SE, Weissenhorn (DE)

( * ) Notice: Subject to any disclaimer, the term of this patent is extended or adjusted under 35 U.S.C. 154(b) by 439 days.

(21) Appl. No.: 17/491,050

(22) Filed: Sep. 30, 2021

(65) Prior Publication Data

US 2024/0410188 A1 Dec. 12, 2024

(51) Int. Cl.

| | |
|---|---|
| ***E04G 17/18*** | (2006.01) |
| ***E04G 13/02*** | (2006.01) |
| ***E04G 19/00*** | (2006.01) |
| *E01D 21/00* | (2006.01) |
| *E04G 13/00* | (2006.01) |

(52) U.S. Cl.

CPC ..... *E04G 17/18* (2013.01); *E04G 13/02* (2013.01); *E04G 19/00* (2013.01); *E01D 21/00* (2013.01); *E04G 13/00* (2013.01)

(58) Field of Classification Search

CPC ..... E04G 17/18; E04G 13/02; E04G 19/00; E04G 13/00; E04G 19/003

See application file for complete search history.

(56) References Cited

U.S. PATENT DOCUMENTS

| | | | |
|---|---|---|---|
| 227,016 A | 4/1880 | Johnson | |
| 260,191 A | 6/1882 | Gould et al. | |
| 621,344 A | 3/1899 | Jones | |
| 711,098 A | 10/1902 | Carr | |
| 1,080,581 A | 12/1913 | John | |
| 1,183,970 A | 5/1916 | Gray | |
| 1,478,562 A | 12/1923 | Jesse | |
| 1,605,777 A | 11/1926 | Richardson | |
| 2,502,285 A | 3/1950 | Smith | |
| 2,788,193 A | 4/1957 | Sanders | |
| 2,994,443 A | 8/1961 | Gordon | |
| 3,861,634 A | 1/1975 | Hood | |
| 3,960,357 A * | 6/1976 | Honea, Jr. | E04G 17/18 249/211 |
| 4,848,732 A | 7/1989 | Rossato | |
| 5,769,396 A | 6/1998 | Tischendorf | |
| 5,890,695 A | 4/1999 | Brewer, III | |
| 6,015,131 A | 1/2000 | Brewer, III | |
| 6,443,429 B1 | 9/2002 | Hawk | |
| 6,605,240 B2 | 8/2003 | Hambelton | |

(Continued)

FOREIGN PATENT DOCUMENTS

| | | |
|---|---|---|
| CN | 103255719 | 8/2013 |
| CN | 205775859 | 12/2016 |

(Continued)

OTHER PUBLICATIONS

"FTF Facade Formwork" published Jun. 2020.

(Continued)

*Primary Examiner* — Beth A Stephan

(74) *Attorney, Agent, or Firm* — SLEMAN & LUND LLP

(57) ABSTRACT

A striking element for striking a construction component from a concrete section, including an anchor section positionable relative to a portion of the concrete section, and a support section configured to support a load of a construction element, the support section configured to vertically lower the construction element.

29 Claims, 20 Drawing Sheets

(56) References Cited

U.S. PATENT DOCUMENTS

| | | | | |
|---|---|---|---|---|
| 6,619,620 | B1 | 9/2003 | Carter | |
| 7,021,861 | B2 | 4/2006 | Basta | |
| 8,052,122 | B2 | 11/2011 | Rossato | |
| 8,448,921 | B2 | 5/2013 | Hernandez | |
| 10,633,873 | B2 * | 4/2020 | Siltala | E01D 19/10 |
| 11,834,852 | B2 * | 12/2023 | Huber | E04G 19/00 |
| 2006/0284147 | A1 | 12/2006 | Matteucci | |
| 2007/0152202 | A1 | 7/2007 | Kinney | |
| 2010/0218452 | A1 | 9/2010 | Wolf | |
| 2017/0251817 | A1 | 9/2017 | Atkinson, Jr. | |
| 2023/0383558 | A1 * | 11/2023 | Johnson | E04G 11/12 |

FOREIGN PATENT DOCUMENTS

| | | | |
|---|---|---|---|
| CN | 106400691 | | 2/2017 |
| CN | 107604829 | | 1/2018 |
| CN | 208685449 | | 4/2019 |
| CN | 210086058 | | 2/2020 |
| CN | 210238297 | | 4/2020 |
| CN | 210262742 | | 4/2020 |
| CN | 210396119 | | 4/2020 |
| CN | 211285295 | | 8/2020 |
| CN | 111676837 | | 9/2020 |
| CN | 211446607 | | 9/2020 |
| CN | 211547412 | | 9/2020 |
| CN | 111764265 | | 10/2020 |
| CN | 211689918 | | 10/2020 |
| CN | 211689942 | | 10/2020 |
| CN | 112813837 | | 5/2021 |
| CN | 113089477 | | 7/2021 |
| CN | 111535196 | B | 8/2021 |
| DE | 3010483 | A | 10/1981 |
| DE | 3409452 | A1 | 9/1985 |
| DE | 19640396 | A1 | 4/1998 |
| DE | 29908482 | | 7/1999 |
| DE | 102009005657 | | 7/2010 |
| DE | 202015002934 | U1 | 6/2015 |
| DE | 202017004423 | U | 9/2017 |
| EP | 1724563 | A2 | 11/2006 |
| EP | 2210979 | A2 | 7/2010 |
| EP | 2638210 | | 9/2013 |
| EP | 2990564 | | 3/2016 |
| EP | 2995749 | A1 | 3/2016 |
| EP | 3030719 | | 6/2016 |
| EP | 3177774 | | 6/2017 |
| EP | 3221519 | | 9/2017 |
| EP | 3221519 | B1 | 9/2019 |
| FR | 1292349 | A | 5/1962 |
| FR | 1414893 | | 10/1965 |
| FR | 2559470 | A1 | 8/1985 |
| GB | 582027 | A | 11/1946 |
| GB | 2436824 | A | 10/2007 |
| GB | 2521920 | A | 7/2015 |
| JP | S55159069 | A | 12/1980 |
| KR | 20060009992 | | 2/2006 |
| KR | 200431156 | | 11/2006 |
| KR | 20070107250 | A | 11/2007 |
| KR | 20100039080 | A | 4/2010 |
| KR | 20100085787 | | 7/2010 |
| KR | 2016088016 | A | 7/2016 |
| KR | 200486454 | | 5/2018 |

OTHER PUBLICATIONS

"Rail Climbing System RCS C" published Oct. 2019.
Peri GmbH, Self-Spanning-Dancefloor, a new formwork concept/structure to form bridge pier caps, Dec. 3, 2020, 18 pages.
Translation of FR 1,414,893. (Year: 1965).

* cited by examiner

STRIKING ELEMENT AND METHOD

RELATED APPLICATIONS

This application is related to U.S. patent application Ser. No. 16/988,492, filed Aug. 7, 2020, entitled STRIKING TOOL AND METHOD, the entire disclosure of which is herein incorporated by reference.

FIELD OF THE INVENTION

The present invention relates to a striking element for striking construction components from concrete.

BACKGROUND OF THE INVENTION

For concreting parts of buildings their shape is first specified by a formwork covering the surface of the building part. The formwork skin is usually formed by formwork elements in the form of simple formwork panels or so-called frame formwork elements. Wherever formwork is to be supported for the pouring of concrete, adjustments at the top or bottom of many supports have to be made for vertical or horizontal positioning of such panels with or without relative movement in one or more directions. Although reusable formwork support brackets mounted on the structural columns of a building under construction have been used heretofore which involve lowering the formwork a short distance onto fixed brackets so that the framework can be removed intact and re-used for other sections of flooring, there are situations in which removing of the brackets and formwork is problematic. If the formwork panel is initially to be supported by means of support elements, it is difficult to release it after concreting because the formwork is under load and adheres to the concrete after the concrete has set. In order to prevent damage during striking off the panel, i.e. striking the panel, it is known for example from EP 2210979 A1 for ceiling panels that lowering devices are integrated into the support devices which allow the formwork elements to be lowered a few centimeters from the surface of the building slab by actuating a striking mechanism of the lowering devices so that the contact pressure on the support elements is eliminated.

For concreting bridgeheads, for example, there are plane formwork panels in use, which can be in a form deviating from a pure plane. Especially in the last process steps of a bridgehead under construction, a formwork is generally in the form of an L, having thus a horizontal and a vertical component. Striking those panel elements by detaching the slab formwork is therefore relatively difficult to accomplish since the panels are restricted in their movement due to their form. Without tools, such as for example hammers, levers or mobile hydraulics, the activation of known lowering devices is usually not possible. Uncontrolled hammer blows when loosening the support elements can lead to functional restrictions and possibly even to early component failure or wear. The process of loosening the support elements before being then completely taken off generally leads to considerable expenditure of personnel and time.

SUMMARY OF THE INVENTION

One aspect of the disclosure provides a striking element for striking a construction component from a concrete section, comprising: an anchor section positionable relative to a portion of the concrete section; and a support section configured to support a load of a construction element, the support section configured to vertically lower the construction element.

In one example, the support section is configured to support a load associated with the construction element, the load comprising the at least one construction component.

In one example, the construction component comprises at least one or more of a main beam, a coupling beam, a platform, or a horizontal formwork.

In one example, the construction element comprises at least one of a beam, a formwork element, a formwork panel, or a pipe.

In one example, the anchor section defines an anchor section longitudinal axis and the support section defines a support section longitudinal axis such that the anchor section longitudinal axis and the support section longitudinal axis are orthogonal.

In one example, the anchor section longitudinal axis is arranged horizontally in use and the support section longitudinal axis is arranged vertically in use.

In one example, the striking element further comprises a waler assembly that engages with the anchor section.

In one example, the support section comprises a hook configured to engage with the construction element.

In one example, rotation of an attachment point on the support section that causes rotation of a threaded rod housed inside the support section thus causes the vertical movement an internally threaded sleeve and the hook relative to the anchor section.

In one example, activation of a hydraulic cylinder causes the vertical lowering of the construction element.

In one example, the attachment point comprises a hexagonal cross section and is capable of being engaged by a tool.

In one example, the support section comprises an extension that extends vertically downwards at a side portion of the concrete section.

In one example, the waler assembly defines a first plurality of waler holes arranged to align with a first plurality of anchor holes defined by the anchor section, such that a pin is insertable into one of the first plurality of walers holes and a corresponding one of the first plurality of anchor holes to fix and align the waler assembly relative to the anchor section.

In one example, the waler assembly defines a second plurality of waler holes arranged to align with a second plurality of anchor holes defined by the anchor section, such that a wedge is insertable into one of the second plurality of waler holes and a corresponding one of the second plurality of anchor holes to fix and align the waler assembly relative to the anchor section in a stepless manner.

In one example, the waler assembly is engaged with the portion of the concrete section by an anchor assembly comprising at least one of: a tie-rod, a screw, a bolt, or a dowel.

In one example, the portion of the concrete section comprises a top portion, and the anchor section is bolted to the top portion of the concrete section.

In one example, the support section further comprises: an elastic element configured to support the construction element and the load associated with the construction element and provide visual feedback indicative of the load associated with the construction element.

In one example, the elastic element comprises at least one of a spring or a rubber buffer.

In one example, the elastic element is located between a top surface of the support section and the attachment point so that the attachment point is distanced from the top surface of the support section by a predetermined distance corresponding to at least a height of the elastic element.

In one example, the support section further comprises: a sleeve indicative of whether an elastic element is installed incorrectly, the elastic element is not installed, or the elastic element has failed.

In one example, the sleeve is located between a top surface of the support section and the attachment point so that the attachment point is distanced from the top surface of the vertical section by a predetermined distance corresponding to at least a height of the sleeve.

Another aspect of the disclosure provides an assembly, comprising: a construction element arranged relative to a concrete section; a striking element positioned relative to a portion of the concrete section and configured to strike a construction component from the concrete section, comprising: an anchor section positionable relative to a portion of the concrete section; and a support section configured to sup ort a load of the construction element, the support section configured to vertically lower the construction element.

In one example, the construction element comprises a beam arranged essentially vertically and the load associated with the construction element comprises a horizontal formwork arranged essentially transversely to the beam.

In one example, the assembly further includes a second striking element positioned relative to an opposing portion of the concrete section such that a first anchor section longitudinal axis of a first anchor section of the striking element is coaxial with a second anchor section longitudinal axis of a second anchor section of the second striking element.

In one example, the assembly further includes a waler assembly engaged with the striking element and the second striking element.

In one example, the assembly further includes a first extension element on a first support section of the striking element; and a second extension element on a second support section of the second striking element, wherein the waler assembly, the first extension element, and the second extension element cooperate to align the striking element and the second striking element relative to the concrete section.

In one example, the waler assembly is engaged with the portion of the concrete section by an anchor assembly comprising at least one of: a tie-rod, a screw, a bolt, or a dowel.

In one example, the first anchor section and the second anchor section are not directly fixed to the concrete section.

In one example, the assembly further includes one or more prop elements positioned atop the portion of the concrete section and configured to support at least one of the anchor section of the striking element and a second anchor section of the second striking element.

In one example, the assembly further includes an anchor assembly configured to fix the waler assembly relative to the concrete section.

In one example, the waler assembly defines a first plurality of holes arranged to align with a plurality of holes defined by the anchor section, such that a pin is insertable into one of the first plurality of holes and a corresponding one of the plurality of holes to fix and align the waler assembly relative to the anchor section.

In one example, the waler assembly defines a second plurality of holes configured to receive a plurality of wedges to provide alignment of the anchor section and the waler assembly in a stepless manner.

Another aspect of the disclosure provides method of striking a construction component from a concrete section, comprising: engaging a striking element with the concrete section; engaging a construction element with a hook of the striking element while the construction element is supported by a jack; lowering the jack such that a load of the construction element and a load associated with the construction element are supported by the striking element; actuating the striking element to lower the hook such that the construction element and the load associated with the construction element are vertically lowered; removing the construction element and the load associated with the construction element.

In one example, the load associated with the construction element comprises the construction component, the construction component comprising at least one or more of a main beam, a platform, or a horizontal formwork.

In one example, the method further includes engaging a gallows at a top portion of the construction element, the gallows defining a plurality of attachment holes configured to engage with a chain of a crane; and attaching the chain of the crane at the attachment hole such that the chain is attached at a center of gravity of the construction element and the load associated with the construction element.

In one example, the method further includes engaging a striking adapter with the construction element and the construction component.

BRIEF DESCRIPTION OF THE DRAWINGS

The invention description below refers to the accompanying drawings, of which.

DETAILED DESCRIPTION

Figure 1:
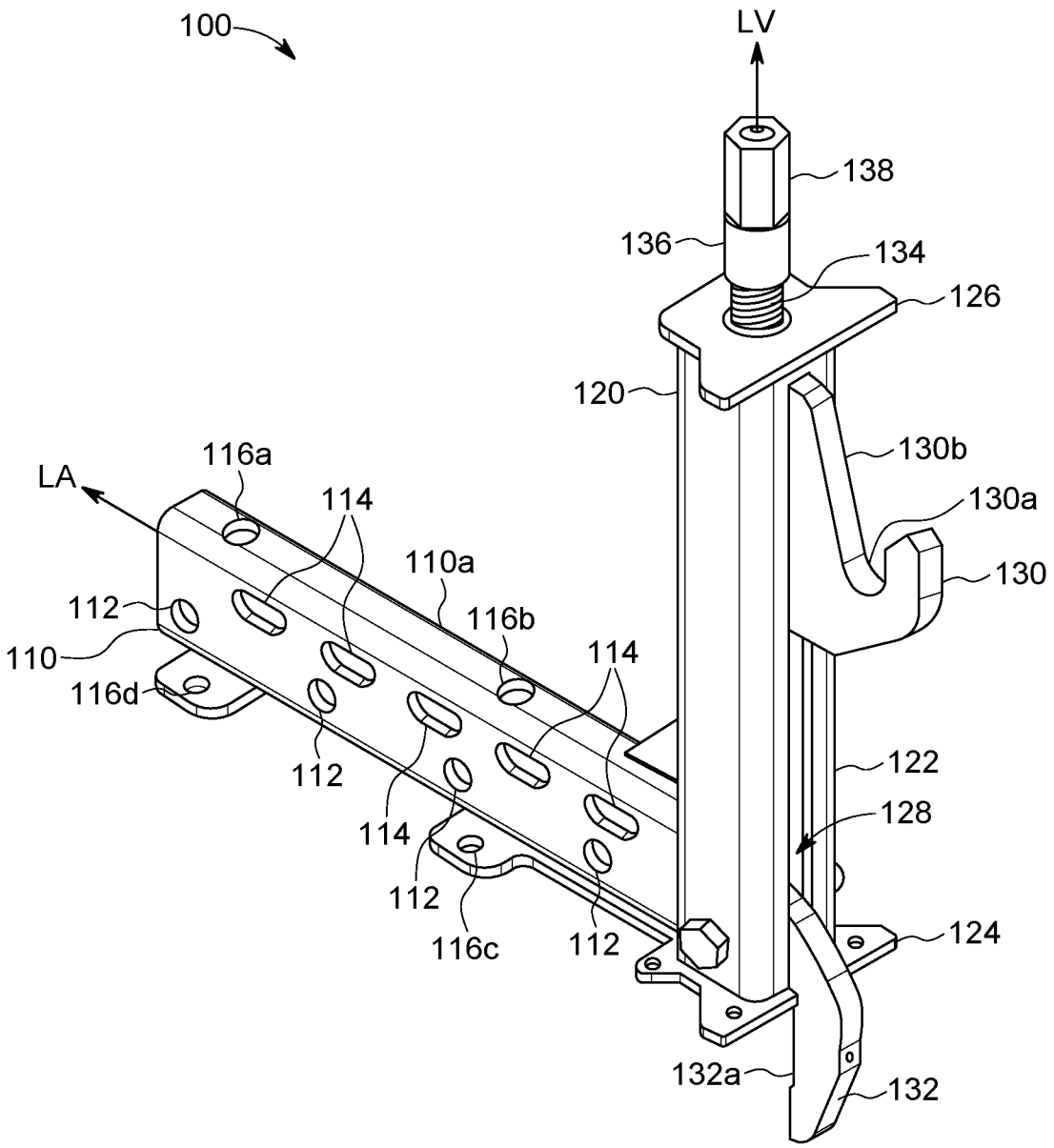
FIG. 1 is a view of a striking element according to one or more aspects of the disclosure.

FIG. 1 is a view of a striking element 100 according to one or more aspects of the disclosure. As shown, the striking element 100 can include an anchor section 110 and a support section 120. The anchor section 110 and the support section

120 can be unitary and formed of steel or any other type of metal. In other examples, certain elements of the striking element 110 can be steel and other can be formed of plastic, rubber, or any type of polymer.

The anchor section 110 can be generally rectangular cuboid shaped, can be hollow, and can generally defined a longitudinal axis LA. The anchor section 110 can define several sets of holes. For example, the anchor section 110 can define a first plurality of holes 112 that are generally circular in cross-section. As shown, the first plurality of holes 112 extend through the width of the anchor section 110 such that opposing sides of the anchor section 110 define identical holes 112. The plurality of holes 112 are regularly spaced along the longitudinal axis LA such that a distance between adjacent holes 112, also referred to as a step, has a predetermined distance. In one example, this step size is approximately 125 mm. As will be explained in greater detail below, the first plurality of holes 112 can be sized and shaped to receive a pin.

The anchor section 110 can define a second plurality of holes 114 that extend through the width of the anchor section 110 such that opposing sides of the anchor section 110 define identical holes 114. The plurality of holes 114 are regularly spaced along the longitudinal axis LA at a distance lesser than the step size associated with holes 112. Each of the second plurality of holes 114 can define a length along the longitudinal axis LA that is greater than a height of the hole measured in a vertical direction (e.g., parallel to axis LV, as will be explained below). In this regard, the second plurality of holes 114 can have an ovular, elliptical, or otherwise rounded shape that is not circular in cross-section. As will be explained in greater detail below, the second plurality of holes 114 can be sized and shaped to receive a wedge.

The anchor section 110 can also define a plurality of anchor holes 116*a, b* defined by a top 110*a* of the anchor section 110, sized and shaped to allow the anchor section 110 to be fixed directly to a concrete section. The anchor section 110 can also defined a second plurality of anchor holes 116*c, d*, extending from a base 110*b* of the anchor section 110, sized and shaped to allow the anchor section 110 to be fixed directly to a concrete section. A pin or bolt can be inserted into one or more of the holes 116*a-d* to fix the anchor section to a section of concrete.

The support section 120 can be generally rectangular cuboid shaped, can be hollow, and can define a longitudinal axis LV such that the axis LV is generally orthogonal or perpendicular to the axis LA. Stated another way, the anchor section 110 and support section 120 can generally define an "L" configuration.

The support section 120 can have an outer housing 122 that generally defines a base 124 and a top 126. Along the longitudinal axis LV, the housing 122 can define a groove 128, which can allow for vertical movement along the longitudinal axis LV of a hook 130. The hook 130 can extend outward from the groove 128 in a direction opposed to the anchor section 110. The hook 130 can define a recess 130*a* and a slanted portion 130*b* that allow for receiving of a construction element, as will be explained in greater detail below. Extending from the groove 128 can be an extension element 132, which extends below the base 124 and has a generally flat internal edge 132*a* configured to be flush with a concrete section.

The support section can include, extending above the top 126, an elastic element 134, a sleeve 136, and an attachment point 138. The elastic element 134 can be a spring, as shown in FIG. 1, or in other examples can be a rubber buffer. The elastic element 134 is arranged between the top 126 of the support section 120 and the sleeve 136, with the sleeve 136 surrounding or enclosing at least a portion of the elastic element 136. The elastic element 134 is also between the top 126 of the support section 120 and the attachment point 138, such that a distance between the top 126 and a bottom of the attachment point 138 is defined at least in part by a height of the sleeve 136 and a portion of the elastic element 134 not enclosed or surrounded by the sleeve 136. Stated another way, the elastic element 134 is positioned between the top 126 and a bottom of the attachment point 138, since the elastic element 134 provides an upward vertical elastic force on the attachment point 138.

The sleeve 136 is arranged between the top 126 of the support section 120 and the bottom of the attachment point 138 and also between a portion of the elastic element 134 not enclosed or surrounded by the sleeve 136 and the bottom of the attachment point 138, such that a distance between the portion of the elastic element 134 not enclosed or surrounded by the sleeve and the bottom of the attachment point 138 is defined at least in part by the height of the sleeve 136.

All or a portion of the attachment point 138 can include a hexagonal cross-section such that the topmost portion of the attachment point 138 can be gripped by a tool (such as a wrench or the like), and be rotated about the longitudinal axis LV.

Figure 2:
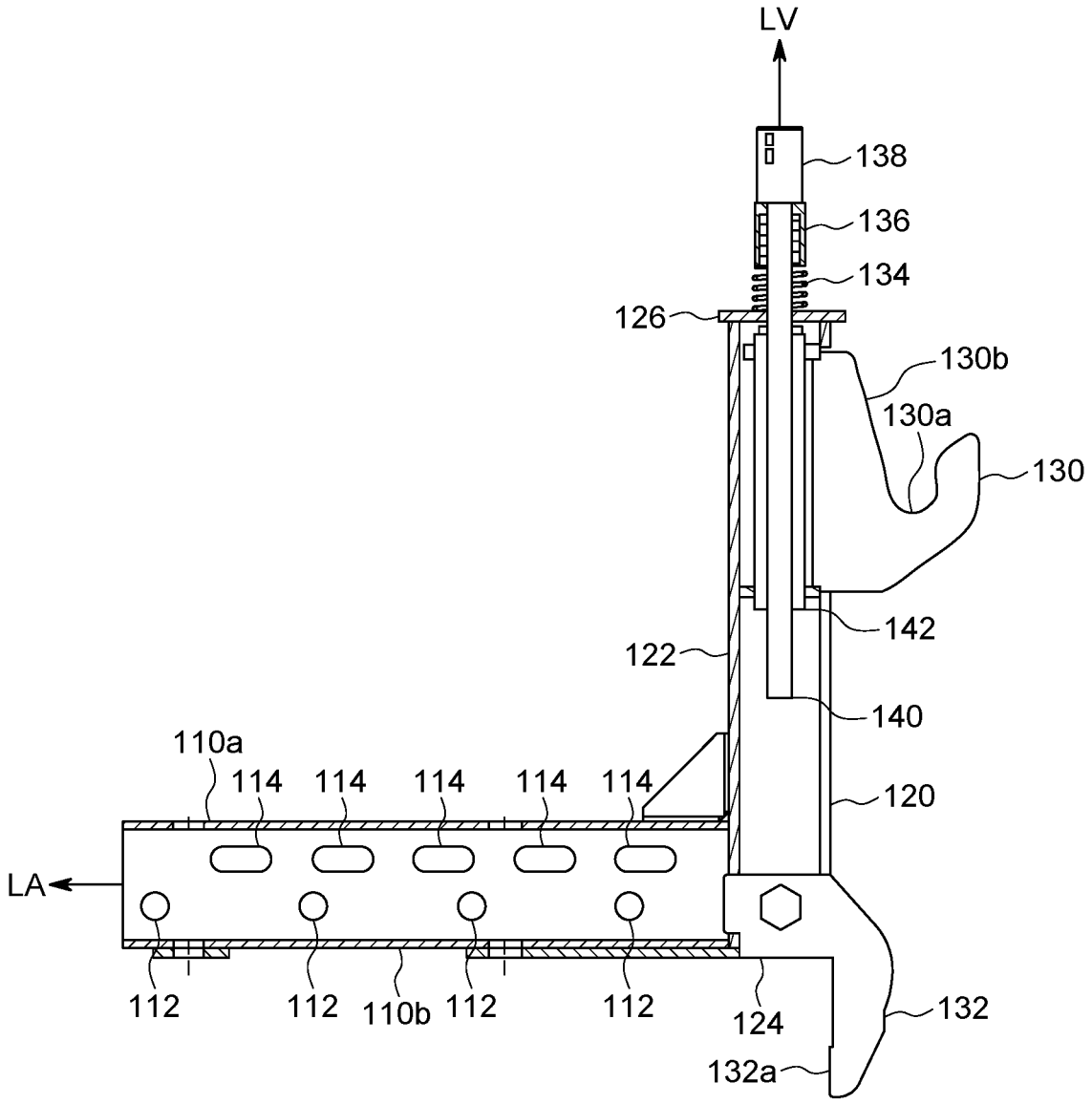
FIG. 2 is a cross-sectional view of the striking element depicting various components within the housing.

FIG. 2 is a cross-sectional view of the striking element 100 depicting various components within the housing 122.

As shown, the attachment point 138 is connected (integrally, directly, or indirectly) to an externally threaded rod 140, such that rotation of the attachment point 138 about the axis LV causes a corresponding rotation of the threaded rod 140. Such rotation of the threaded rod 140 in turn causes vertical movement (raising or lowering, depending upon direction of rotation of attachment point 138) of an internally threaded sleeve 142 along the axis LV, which causes vertical movement (again, raising or lowering depending upon direction of rotation of attachment point 138) of the hook 130 along the axis LV relative within a track defined by the groove 128. This is due to the threaded sleeve 142 being fixed (e.g., welded permanently) to the hook 130. Such raising or lowering of the hook can in turn cause vertical raising or lowering (in one example, strictly along the axis LV with no component of motion along the axis LA) of a construction element engaged with the hook (and any load associated therewith).

As shown, both the sleeve 136 and the elastic element 134 surround the threaded rod 140, and based upon a load supported by the hook 130, the sleeve 136 and the elastic element 134 can provide visual feedback to a user regarding the status of the load.

In another example, the striking element 100 described above can incorporate a hydraulic assembly that allows for raising or lowering of the hook 130. In this regard, activation of the hydraulic cylinder can cause vertical motion of the hook 130 and thus a construction element and/or load associated therewith.

Figure 3:
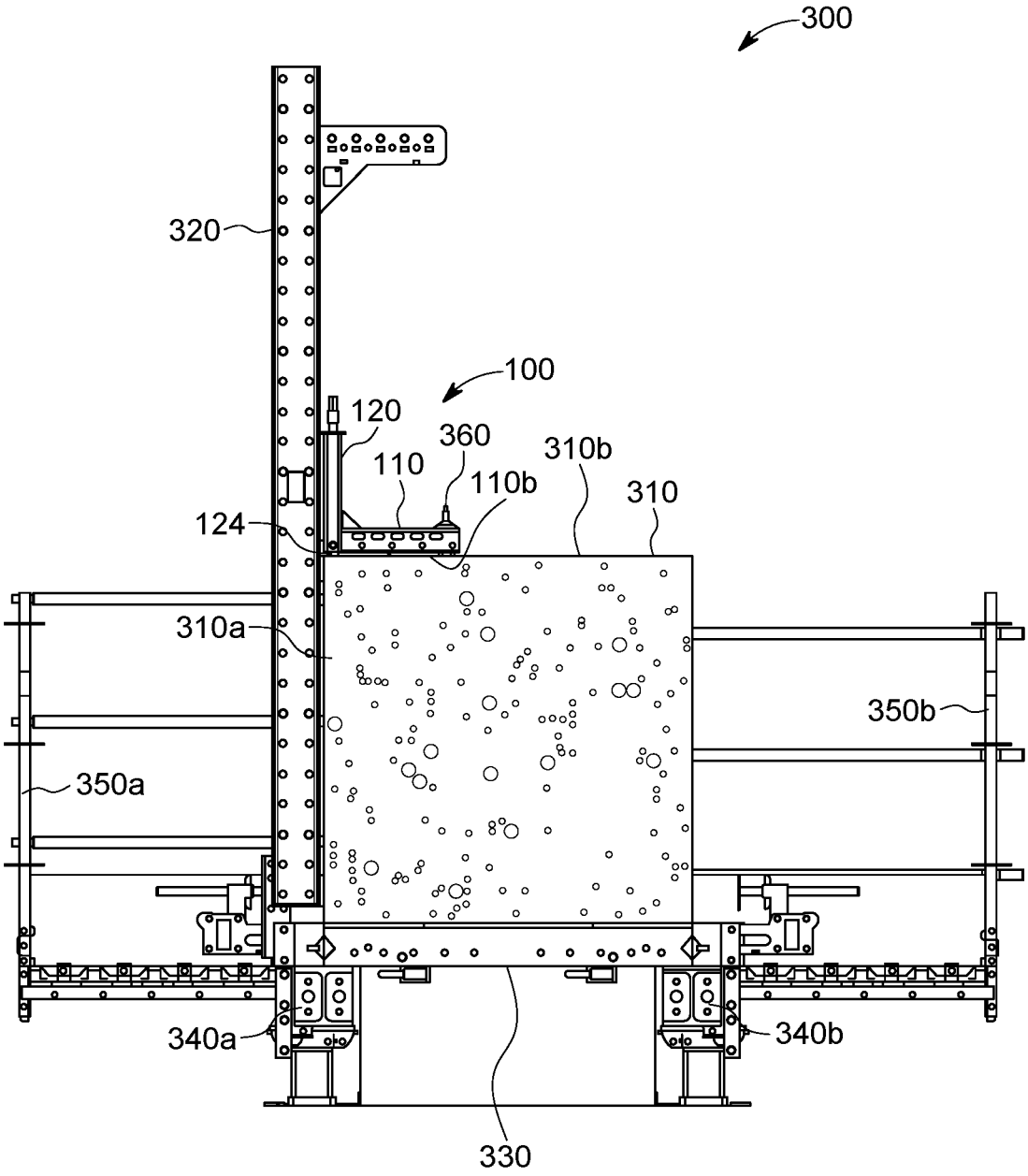
FIG. 3 depicts a system including a striking element engaged with a concrete section and a construction element in preparation for striking the construction element from the concrete section

FIG. 3 depicts a system 300 including a striking element 100 engaged with a concrete section 310 and a construction element 320 in preparation for striking the construction element 320 from the concrete section 310. In use, the anchor section 110 is generally arranged horizontally along the axis LA and the support section is generally arranged vertically along the axis LV.

The concrete section 310 can be any type of hardened or cured concrete and can have any type of three-dimensional shape depending on the particular project specifications. In some examples, the concrete section 310 can be a bridge head pier, which can have a generally rectangular cuboid, cubic, or cylindrical shape.

The construction element 320 (any of the exemplary construction elements or components described herein) can be any type of construction element, such as a beam, a formwork element, a formwork panel, a pipe, etc. In the example of FIG. 3, the construction element 320 is a beam that is positioned flush against a side 310*a* of the concrete section 310.

The system 300 can also include various other construction elements or components, such as a horizontal beam 330, one or more main beams 340*a, b* that can be arranged perpendicular to the horizontal beam 330, and one or more platforms 350*a, b* configured to support a worker or work materials.

In this example, the striking element 100 is fixed directly to a top 310*b* of the concrete section 310 such that the base 110*b* of anchor section 110 and the base 124 of support section 120 are flush against the top 310*b*. This can be achieved by an anchor assembly 360 (e.g., a tie-rod, bolt, dowel, or screw) positioned at an end of the anchor section 110 opposed from the support section 120 and through the hole 116*a*.

Figure 4:
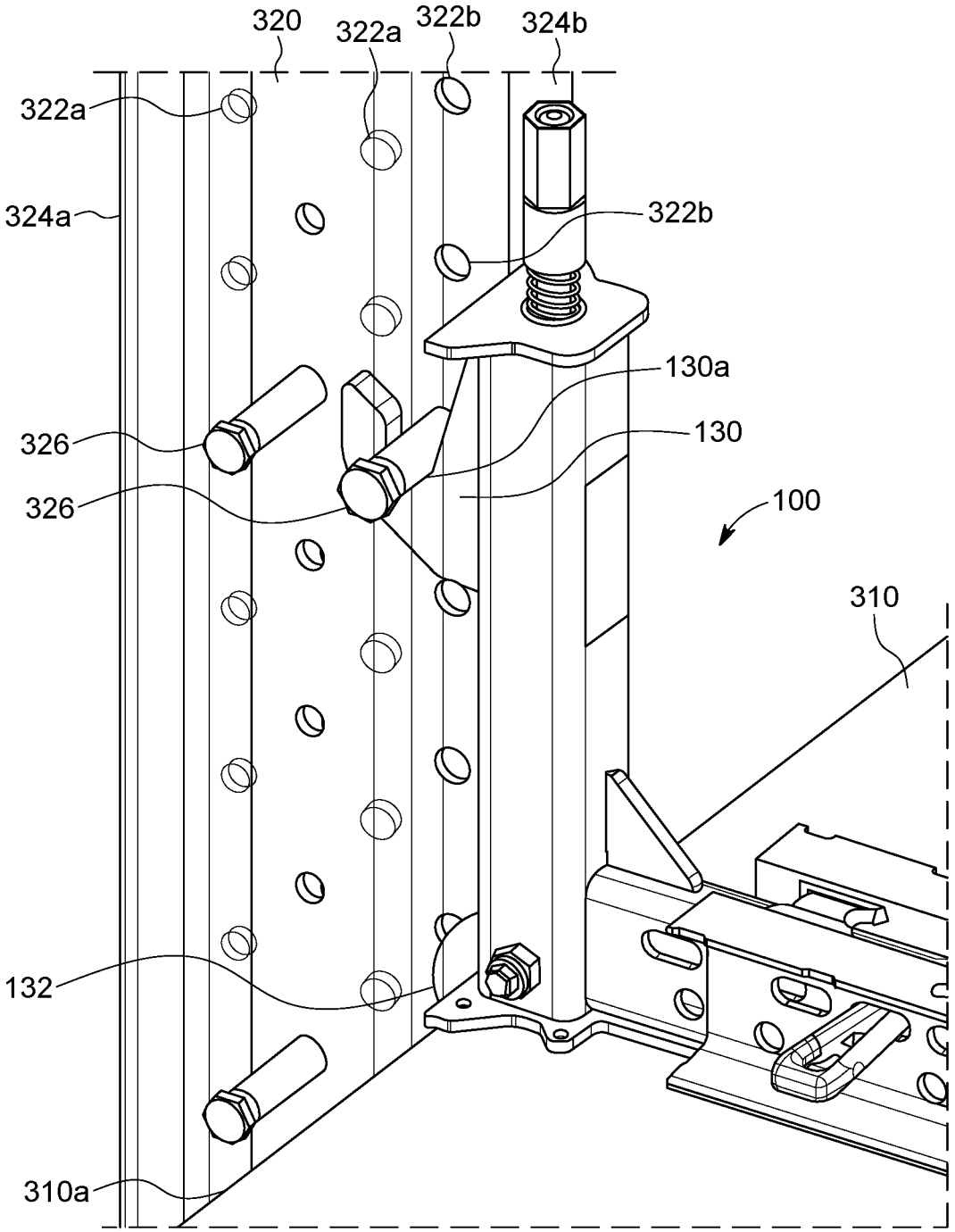
FIG. 4 depicts a close up perspective view of the striking element engaged with the construction element and the concrete section.

FIG. 4 depicts a close up perspective view of the striking element 100 engaged with the construction element 320 and the concrete section 310. For ease of viewing, a first side 324*a* of the construction element 320 is depicted in phantom. As shown, the construction element 320 can define a plurality of holes 322*a* on a first side 324*a* that align with corresponding holes 322*b* on the second side 324*b*. In this regard, one or more pins or bolts 326 can be inserted into the corresponding holes such that the entire construction element 320 can be raised or lowered via the pins or bolts 326. As depicted, the pin or bolt 326 facing the striking element 100 is engaged in the recess 130*a* defined by the hook 130. As also depicted, the extension 132 is flush against a side section 310*a* of the concrete section 310.

Figure 5:
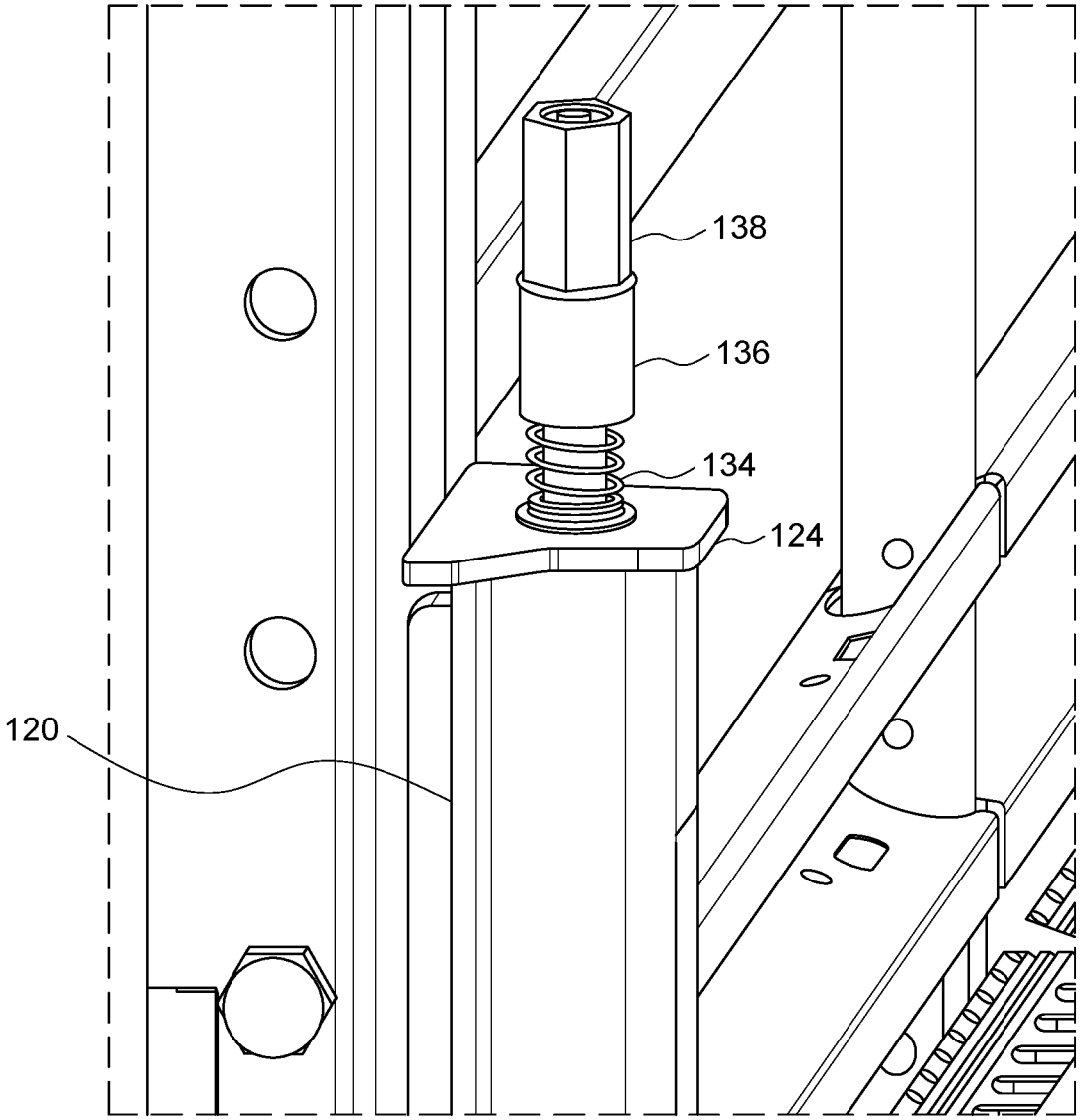
FIG. 5 depicts the support section of the striking element, depicting the elastic element, sleeve, and attachment point.

FIG. 5 depicts the support section 120 of the striking element 110, depicting the arrangement of elastic element 134, sleeve 136, and attachment point 138.

Figure 6:
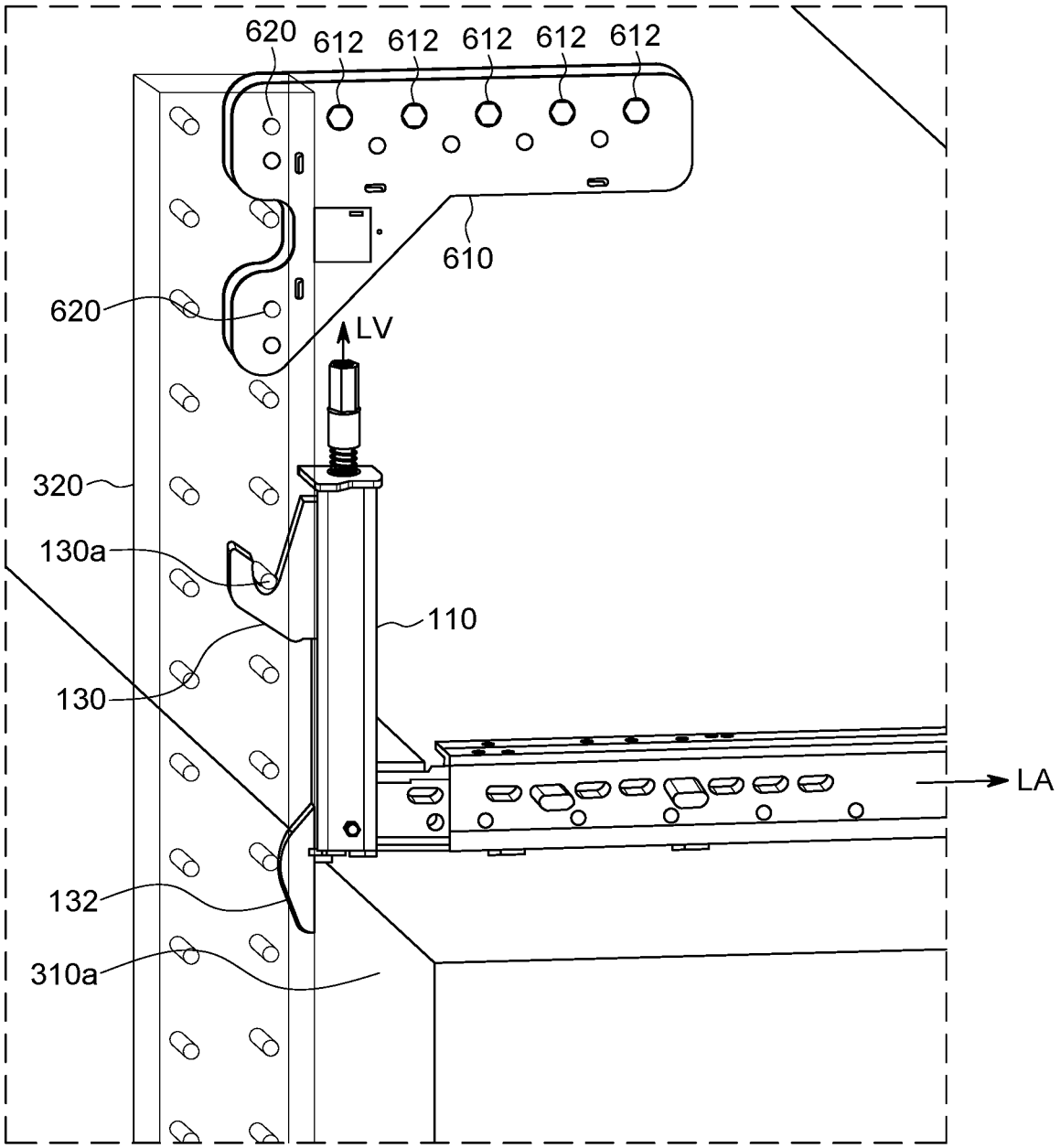
FIG. 6 depicts the striking element engaged with the construction element as shown above, with the extension flush against the side section.

FIG. 6 depicts the striking element 110 engaged with the construction element 320 (shown in phantom) via recess 130*a* of hook 130, with the extension 132 flush against the side section 310*a*. Also depicted is a gallows 610 engaged with the construction element 320 (shown in phantom).

The gallows 610 defines a plurality of attachment holes 612 arranged regularly along an axis generally parallel to LA. As also shown, the gallows 610 is engaged with the construction element 320 by pins 620 that pass through holes defined by both the gallows 610 and the construction element 320. As will be explained in greater detail below, attachment of a chain of a crane to one of the holes 612 can be selected depending on a center of gravity.

Figure 7A:
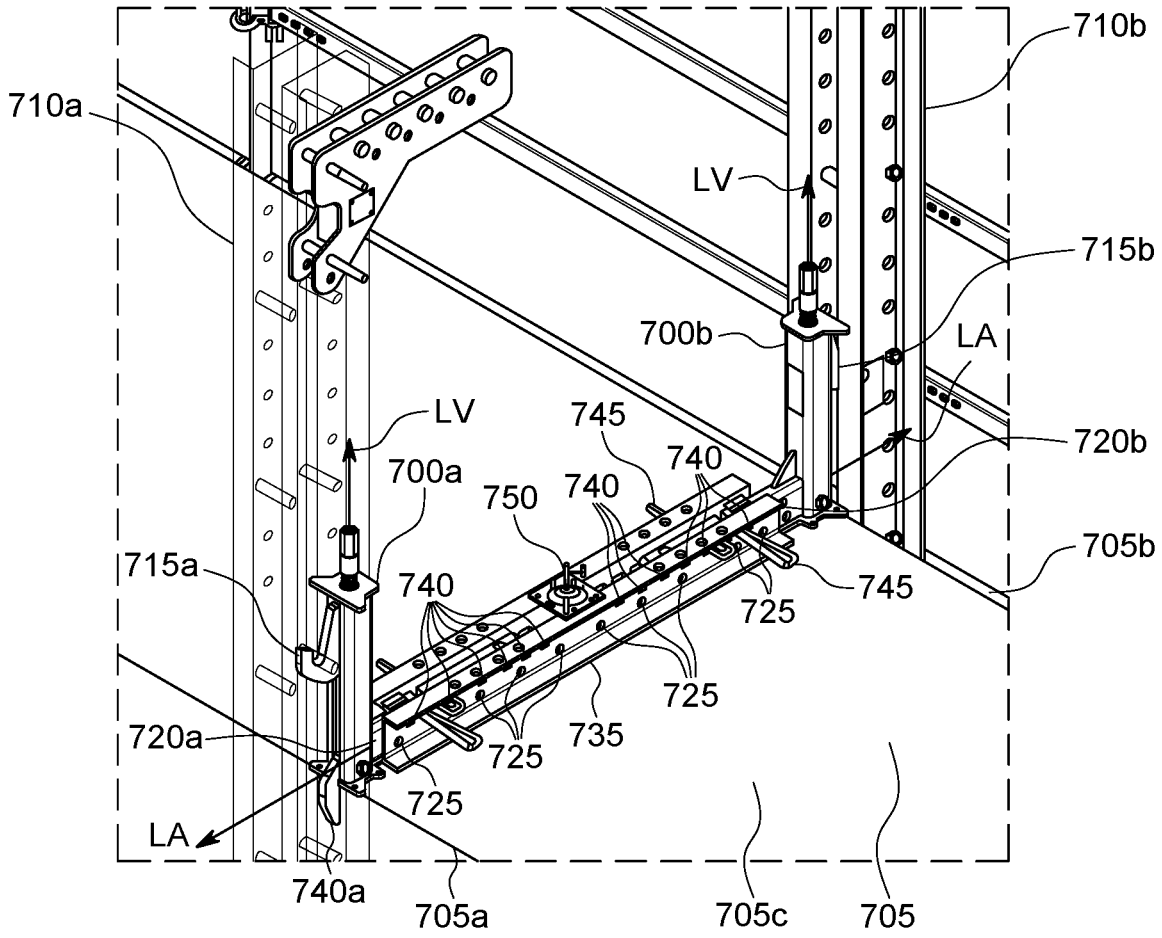
FIG. 7A depicts a technique for attaching striking elements to a concrete section.

FIG. 7A depicts a technique for attaching striking elements 700*a, b* to a concrete section 705. As shown, the striking elements 700*a, b* are engaged respectively with construction elements 710*a, b* via hooks 715*a, b* and the respective longitudinal axes LA of the anchor sections 720*a, b* of the striking elements 70*a, b* are coaxial.

The respective anchor sections 720*a, b* of the striking elements 700*a, b* are both aligned and fixed relative to one another by a waler assembly 735.

The waler assembly 720 has a plurality of sets of holes. The first plurality of holes 725 correspond to the first plurality of holes 112 defined by the anchor sections 720*a, b*. These holes 725 can also be seen in FIG. 8. The holes 725 are defined in both lateral sides of the of the waler assembly 735 relative to the LA and can align with the first plurality of holes 112 such that one or more pins (not shown) can be inserted into a hole (one of holes 725), pass through one of the first plurality of holes 112, and pass through the oppositely oriented hole (one of 725). This can be repeated for some or all of the holes 725. The same technique can be used on the striking element 700*b*.

In this regarding, a length of the combined structure of the striking elements 700*a, b* and waler 735 can be adjusted by removing one or more pins (not shown), and moving one or both of the striking elements 700*a, b* and/or the waler 735 along the LA to length or shorten the assembly relative to the length of the section of concrete 705. In support of this, the extensions 740*a* (and an extension for striking element 700*b*, not shown) extends below the striking elements 700*a, b* to be flush against sides 705*a, b* of the concrete section 705, thereby preventing motion in one direction (e.g., toward a center of the concrete section 705) along the longitudinal axis LA of the striking elements 700*a, b*. Once a desired position is identified, an anchoring assembly 750 can be assembled to fix the waler 735 to a top 705*c* of the concrete section 705, thereby fixing the striking elements 700*a, b* to the concrete section 705. The holes 725 can be positioned regularly along the LA such that a distance between the holes, e.g., a step size, is constant. In one example, the step size is 125 mm. The step size of the holes 725 can be identical to the step size of the holes 112 to ensure alignment of the waler 735 and anchor sections 720*a, b*.

Also depicted are a second plurality of holes 740. A distance between adjacent holes 740 is smaller than the step size associated with holes 725, thus allowing for a stepless or step-free adjustment of the assembly along the longitudinal axis. The holes 740 correspond in size, shape, and position to the second plurality of holes 114 of the anchor sections 720*a, b*. One or more wedges 745 can be inserted into one of the holes 740, through one of the holes 114, and through the opposing holes 740 of the waler, thereby fixing and aligning the striking elements 700*a, b* relative to the waler 735. Similar to above, one or more wedges 745 can be placed or removed relative to holes 740 and holes 114 to allow for alignment one or more of the waler 735 or striking element 700*a, b*. As shown in FIG. 7A, two wedges 745 are used, which allows the assembly of striking elements 700*a, b* and waler 735 to be fixed steplessly in any position by virtue of the holes 740 and holes 114. In support of this, the extensions 740*a* (and an extension for striking element 700*b*, not shown) extends below the striking elements 700*a, b* to be flush against sides 705*a, b* of the concrete section 705, thereby preventing motion in one direction (e.g., toward a center of the concrete section 705) along the longitudinal axis LA of the striking elements 700*a, b*. Once a desired position is identified, the waler assembly 735 can be fixed directly to the a top 705*c* of the concrete section 705 by the anchor assembly 750 (e.g., tie-rod, bolt, screw, dowel, etc.), thereby fixing the waler assembly 735 to the concrete section 705 and the anchor sections 720*a, b* to the concrete section by way of waler assembly 735.

Figure 7B:
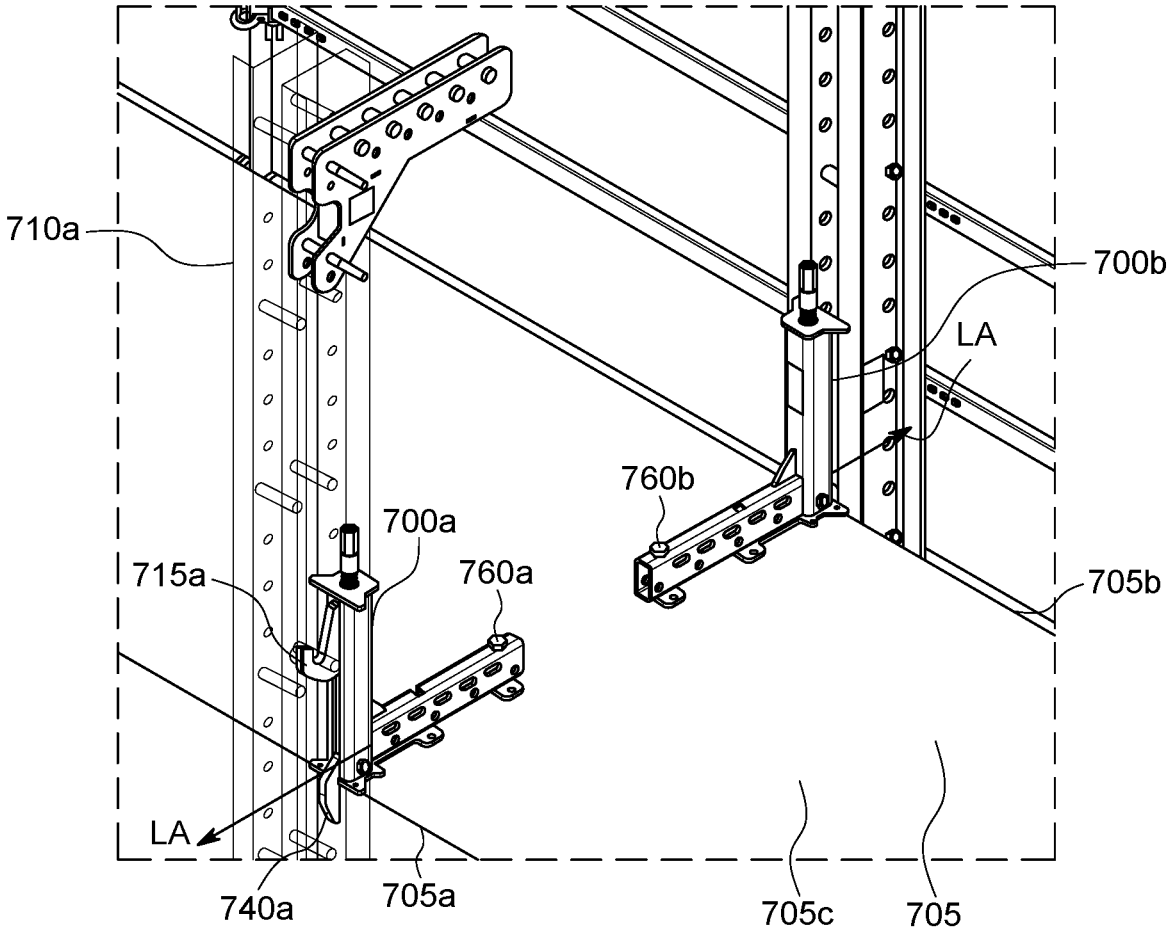
FIG. 7B depicts a technique for attaching striking elements to a concrete section.

FIG. 7B depicts a technique for attaching striking elements 700*a, b* to a concrete section 710. In this example, one or more bolts 760*a, b* are placed directly through the holes (e.g., 116*a* depicted in FIG. 1) defined at the top surface 705*c* of the anchor section 705 and directly fixes the anchor sections 720*a, b* directly to a top 705*c* of the concrete section 705 without the use of the waler. In other examples, one or more of holes 116*b-d* may be used, in addition to or independent from, holes 116*a* for fixing the anchor sections 720*a, b* directly to the top surface 705*c*.

Figure 8:
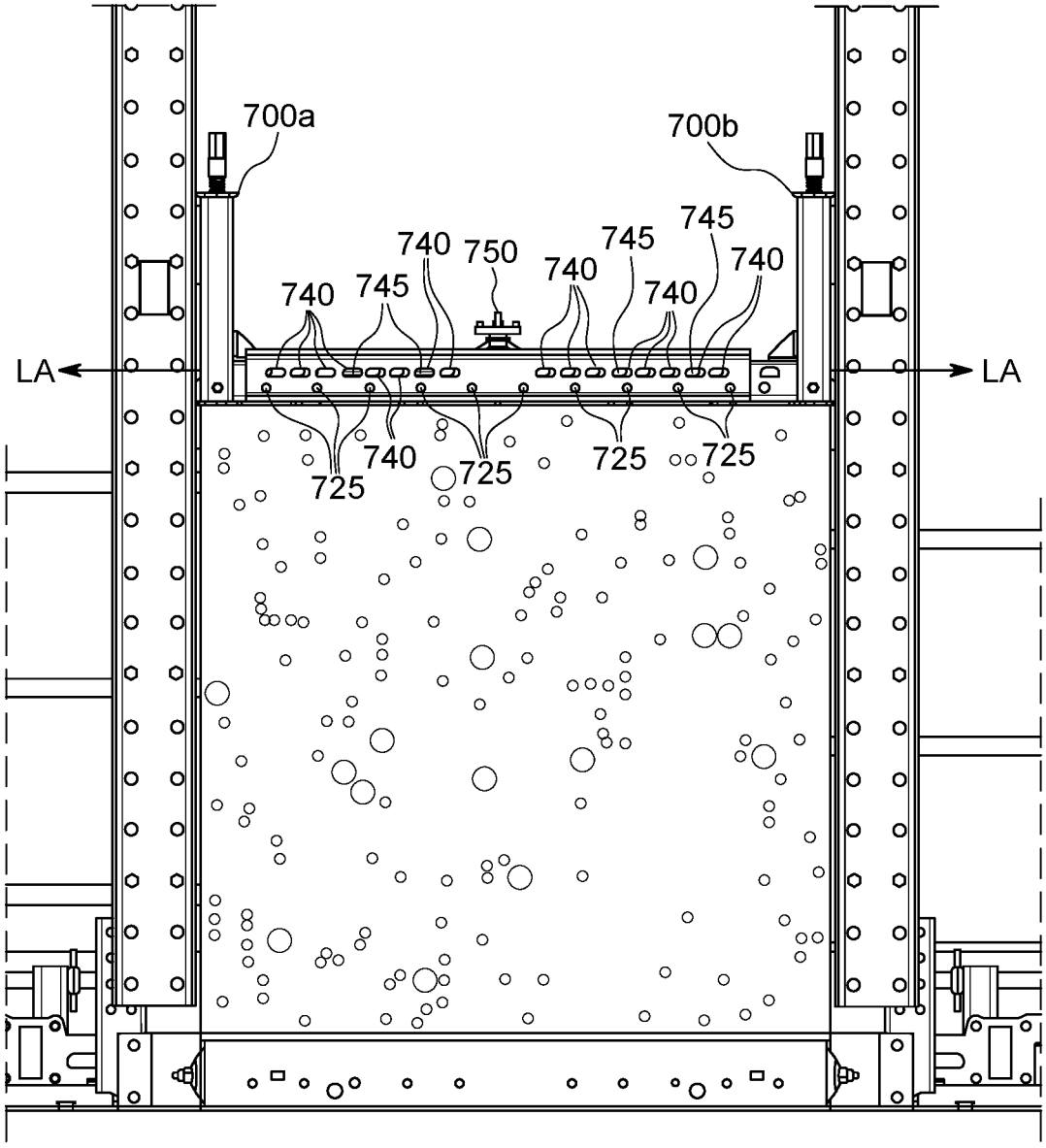
FIG. 8 depicts the attaching technique of FIG. 7A in which wedges are used.

FIG. 8 depicts the attaching technique of FIG. 7*a* in which wedges 745 are used relative to holes 740. As also shown, the anchor assembly 750 (in this example a tie-rod), is arranged at a relatively central point of the waler 735 relative to the length of the concrete section 705 and a positioning of the striking element 700*a, b*. In other examples, the anchor assembly 735 can be adjusted along the LA depending on the project specifications. While the wedges 745 are depicted in use in FIG. 8 in a stepless manner, in another example the holes 725 can be used in conjunction with one or more pins instead of or in addition to wedges 745 and holes 740.

Figure 9:
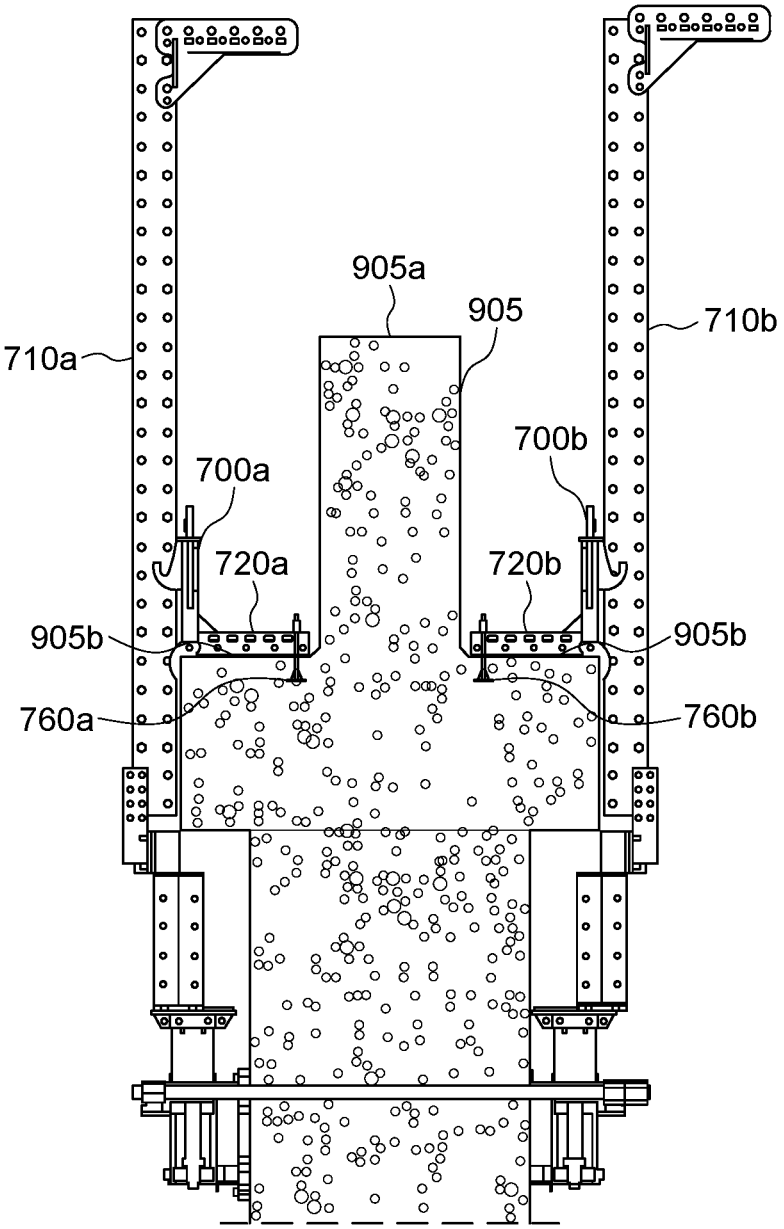
FIG. 9 depicts the attaching technique of FIG. 7B in the context of an inverted T-block.

FIG. 9 depicts the attaching technique of FIG. 7B in the context of a concrete structure 905 in the form of an inverted T-block. In this regard, the concrete structure 905 has an upper surface 905*a* and a pair of lateral lower surfaces 905*b*. As shown, the striking elements 700*a, b* are attached directly to respective lateral lower surfaces 905*a, b* of the concrete section 905 by bolts 760*a, b*. This allows for the striking elements 700*a, b* to be fixed relative to the concrete 905 in a situation where a waler may not be desirable due to the inverted T-block formation.

Figure 10:
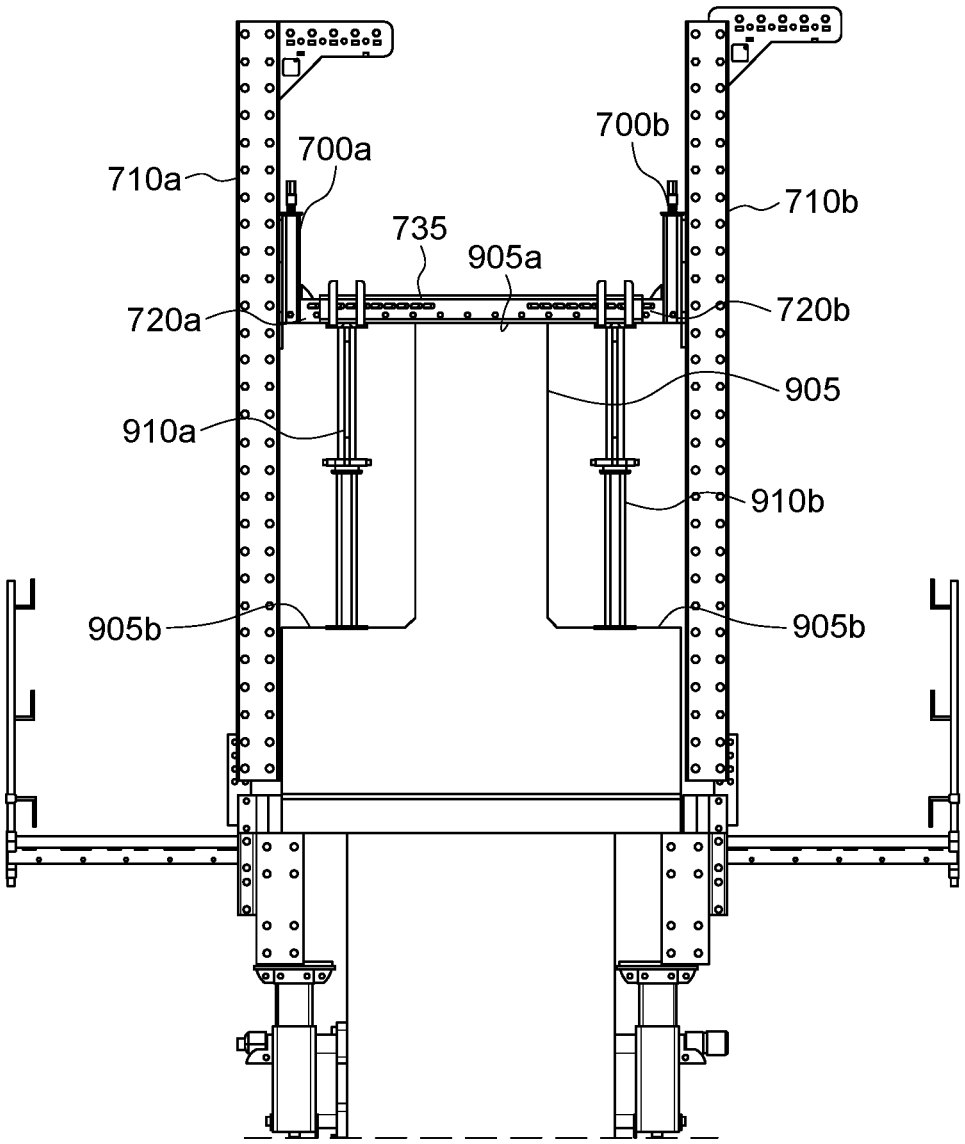
FIG. 10 depicts the attaching technique of FIG. 7A in the context of an inverted T-block.

FIG. 10 depicts the attaching technique of FIG. 7A in the context of a concrete structure 905 in the form of an inverted T-block. In this regard, the concrete structure 905 has an upper surface 905*a* and a pair of lateral lower surfaces 905*b*. The striking elements 700*a, b* can be engaged with the waler 735 by one or both of the first plurality of holes (e.g., 725) or second plurality of holes (740) described above in FIG. 7A. In this scenario, a pair of props 910*a, b* support the waler assembly 735 and the anchor sections 720*a, b* of the striking elements 700*a, b*. An anchoring assembly (not shown, but for example 750 of FIGS. 7A and 8) can fix the waler assembly 735 relative to the upper surface 905*a* of the concrete section 905. In this example, the extensions (e.g., 740*a, b*) do not engage with the concrete section 905, as they are elevated relative to the lower surfaces 905*b*.

FIGS. 11A-I depict various stages of striking a construction component from a concrete section.

Figure 11A:
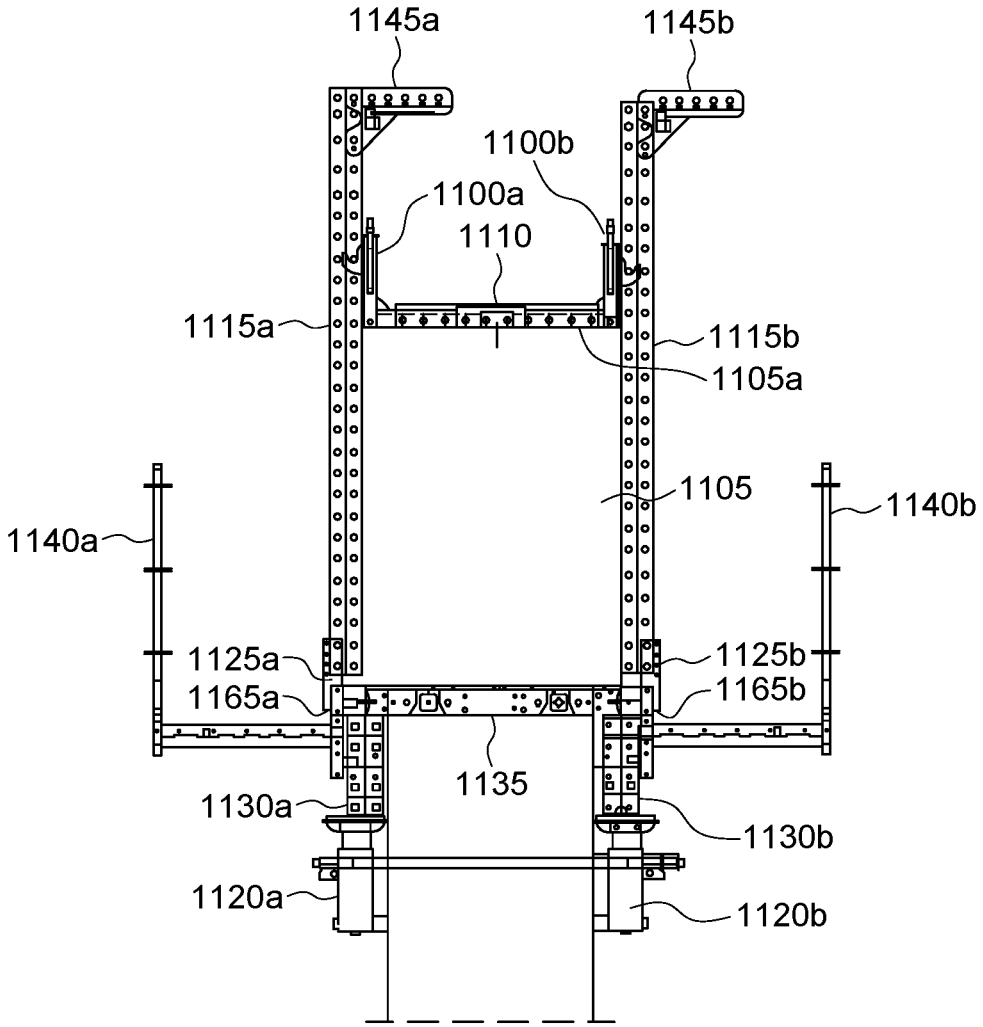
FIGS. 11A-I depict various stages of striking a construction component from a concrete section.

At FIG. 11A, a pair of striking elements 1100*a, b* are installed relative to a top section 1105*a* of the concrete section 1105. As shown, the striking elements 1100*a, b* can be installed using a waler assembly 1110 and can be installed according to any of the techniques described above, such as those in FIG. 7A. Alternatively, the striking elements 1100*a, b* could be installed without a waler, as depicted in FIG. 7B. Also shown are construction elements 1115*a, b* engaged with respective striking elements 1100*a, b* and being supported by respective jacks 1120*a, b*.

Also shown are respective striking adapters 1125*a, b* that are connected to both the respective construction elements 1115*a, b* and to respective coupling beams 1165*a, b* and allow the construction element 1115*a*, main beam 1130*a*, coupling beam 1165*a*, and platform 1140*a* (and optionally horizontal formwork 1135) to be moved as one assembly. Similarly, the construction element 1115*b*, main beam 1130*b*, coupling beam 1165*b*, and platform 1140*b* (and optionally horizontal formwork 1135) can be moved as one assembly. This allows the construction elements 1115*a, b* to support a load defined at least in part by one or more construction components (e.g., any of 1130*a, b*, 1135, 1165*a, b*, and/or 1140*a, b*) positioned below the construction elements 1115*a, b*. While horizontal formwork 1135 is depicted, other types of elements could be implemented instead of or in addition to such horizontal formwork 1135, such as any type of supporting formwork, waler, beam, etc. In one example, the construction elements 1115*a, b* are arranged generally vertically and the horizontal formwork 1135 is arranged generally horizontally and transverse to one or both of the construction elements 1115*a, b*.

The load associated with the construction elements 1115*a, b* can include one or more construction components, for example, one or more of main beams 1130*a, b*, horizontal formwork 1135, coupling beams 1165*a, b*, and platforms 1140*a, b*. In particular, a load of the construction elements 1115*a* or 1115*b* themselves exists by virtue of the mass of the construction elements 1115*a* or 1115*b*. Further, a further load associated with construction element 1115*a* can exist by virtue of additional construction components that are engaged to and/or vertically supported by the construction elements 1115*a*, such as main beam 1130*a*, coupling beam 1165*a*, platform 1140*a*, and optionally horizontal formwork 1135. The further load associated with construction element 1115*b* can be additional construction components comprising at least main beam 1130*b*, coupling beam 1165*b*, platform 1140*b*, and optionally horizontal formwork 1135. Only one of the construction elements 1115*a* or *b* will be associated with horizontal formwork 1135 as its load, as will be shown below.

Also shown in FIG. 11A are respective gallows 1145*a, b* that are respectively engaged with construction elements 1115*a, b* at a top portion thereof. As mentioned above with respect to FIG. 6, the gallows 1145*a, b* can define a plurality of attachment holes for engaging with a chain of a crane, with the selected attachment hole being selected based upon a center of gravity of the load.

Figure 11B:
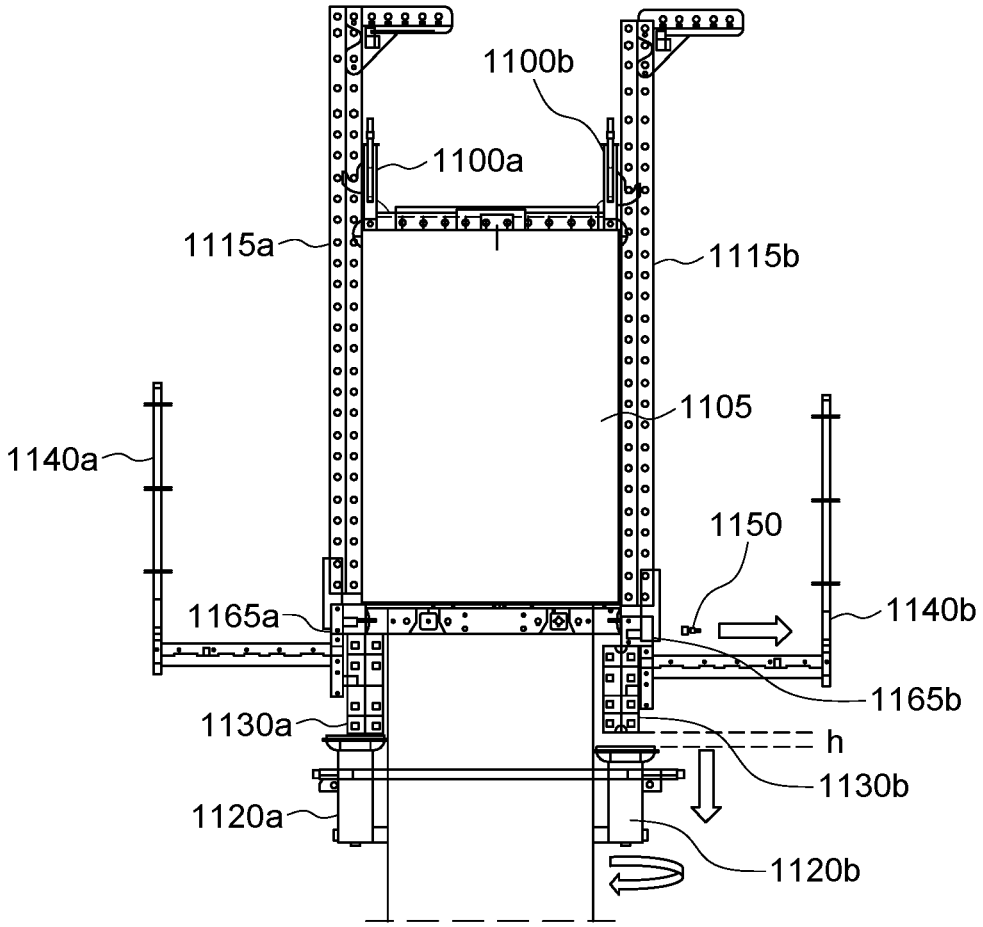

As shown in FIG. 11B, a bolt 1150 is removed that fixes the coupling beam 1165*b* relative to the horizontal formwork 1135, thus excluding the horizontal formwork 1135 from the load associated with construction element 1115*b*. Such bolt 1150 can be, for example, an X-bolt as described U.S. application Ser. No. 16/988,538, filed Aug. 7, 2020 to Huber et al, the teachings of which are incorporated herein by reference. Once the bolt 1150 is removed, the jack 1120*b* can be lowered from a first position to a second lower position by some height h. Once this is done, the construction element 1115*b* and the load (e.g., 1130*b* and 1140*b*) are supported entirely by the striking element 1100*b* and the concrete section 1105.

In this regard and with reference to FIGS. 11A and 11B, each of the striking elements 1100*a, b* can each have support sections (e.g., 120) each having a respective elastic element (e.g., 134) and a sleeve (e.g., 136) discussed above with respect to FIGS. 1, 2, 4, and 5. In the state depicted in FIG. 11A, the construction element 1115*b* and load (e.g., 1130*b*, 1140*b*, 1165*b*, and optionally 1135) is supported by the jack 1120*b*. In this regard, the striking element carries no load while the jack 1120*b* supports the load of the construction element 1115*b* and load of construction components (e.g., 1130*b*, 1140*b*, 1165*b*, and optionally 1135).

When the jack 1120*b* is lowered as shown in FIG. 11B, the striking element 1120*b* must not only support a load of the construction element 1115*b* and load of construction components (e.g., 1130*b*, 1165*b*, 1140*b*, and optionally 1135), but also an additional load created by the main beam 1130*b* when the jack 1120*b* is lowered.

This additional load associated with the main beam 1130*b* arises where the main beam 1130*b* is supported on opposite ends by the jacks 1120*b* (rear jack not shown) and the jacks 1120*b* are lowered. The middle portion of the main beam 1130*b* deflects downward while ends of the main beam 1130*b* are supported by the jacks 1120*b* and the jacks 1120*b* support the bent/deflected main beam 1130*b*. When the jacks

1120*b* are removed, the main beam 1130*b* bends/deflects into a straightened horizontal configuration, which creates a temporary, but significant, additional load from when the jacks 1120*b* are removed and until the main beam 1130*b* returns/deflects back to its originally substantially unbent/undeflected orientation.

The striking element 1100*b*, without the addition of the elastic element (e.g., 134), may not be capable of accommodating the increased load. To accommodate this additional load, the elastic element (e.g., 134) creates a gap between the top (e.g., 126) of the striking element 1100*b* and the attachment point (e.g., 138). The elastic element thus pushes vertically the entire assembly of the hook (e.g., 130), internally threaded sleeve (e.g., 142), threaded rod (e.g., 140), sleeve (e.g., 136) and attachment point (e.g., 138). This distance between the top (e.g., 126) of the striking element and attachment point (e.g., 138) allows the entire assembly including the hook (e.g., 130), internally threaded sleeve (e.g., 142), threaded rod (e.g., 140), sleeve (e.g., 136) and attachment point (e.g., 138) to move downward by virtue of compression of the elastic element (e.g., 134), approximately down to the a position where the sleeve (e.g., 136) is nearly in contact with the top (e.g., 124) of the striking element 1100*b* when the jack 1120*b* is removed or lowered. Such compression of the elastic element (e.g., 134) provides visual feedback regarding the status of the construction element and the load associated therewith. The additional load created by the deflection above compresses the elastic element and the distance between the top of the striking element and the attachment point decreases. Then, by activating the attachment point (e.g., by rotating) the construction element 1115*b* can be lowered (as shown in FIG. 11C) as the striking element 1100*b* need only support the load of construction element 1115*b*, main beam 1130*b*, coupling beam 1165*b*, and platform 1140*b* (optionally horizontal formwork 1135).

The sleeve (e.g., 136) serves as a backup to the elastic member in the event that the elastic element (e.g., 134) is installed incorrectly, not at all, or otherwise fails. In this case, the sleeve would then be compressed rather than the elastic element (e.g., 134). Such compression is indicative that the elastic element is installed incorrectly, not at all, or otherwise fails. The sleeve (e.g., 136) also keeps the attachment point (e.g., 138) and top (e.g., 124) of the striking element 1100*b* separated by a distance. If neither the elastic element nor sleeve were implemented and thus there was no clearance distance between the attachment point and the top of the striking element, the striking element would be overloaded by the temporary additional load caused by the deflection of the main beam 1130*a, b* or other heavy load.

Figure 11C:
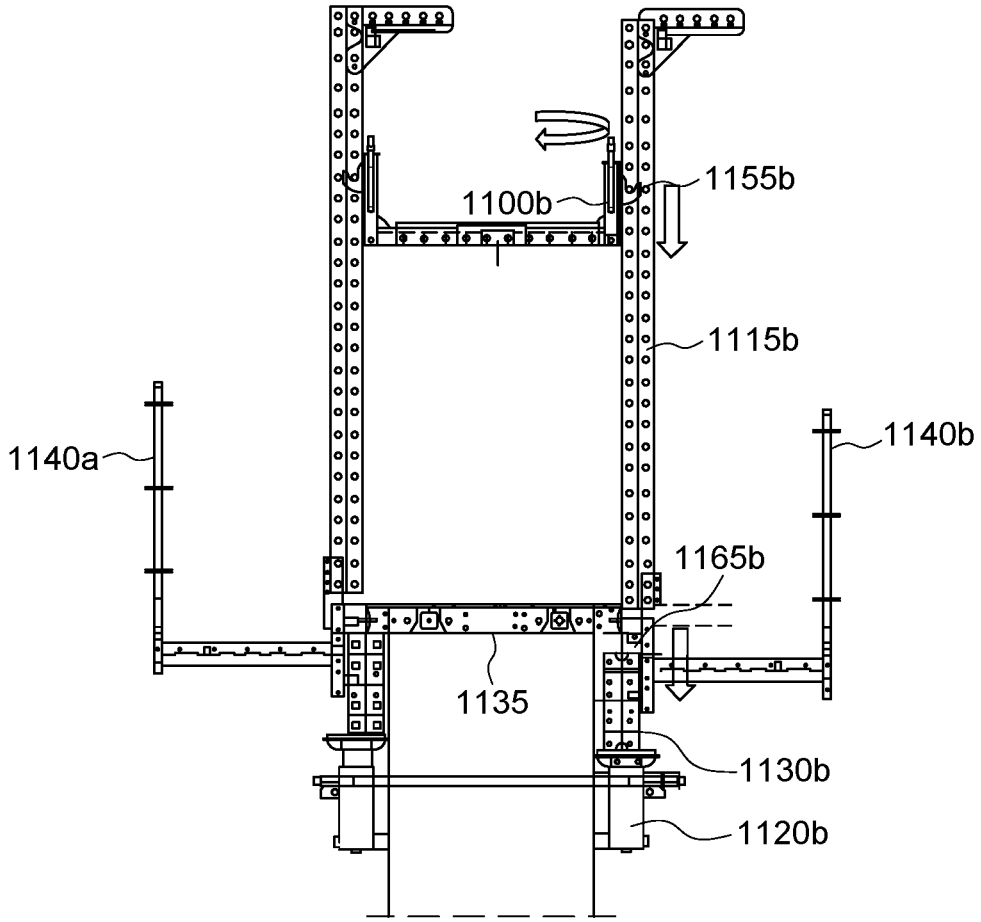

As shown in FIG. 11C, the striking element 1100*b* is actuated (e.g., rotation of the attachment point) such that the hook 1155*b* is lowered by a distance. By virtue of the hook 1155*b* lowering, the construction element 1115*b* also lowers vertically as well as the load (e.g., 1130*b*, 1165*b*, optionally 1135, and 1140*b*) by virtue of the striking adapter 1125*b* being engaged with construction element 1115*b* and coupling beam 1165*b*, thus the entire assembly is supported by the striking element 1100*b*.

Figure 11D:
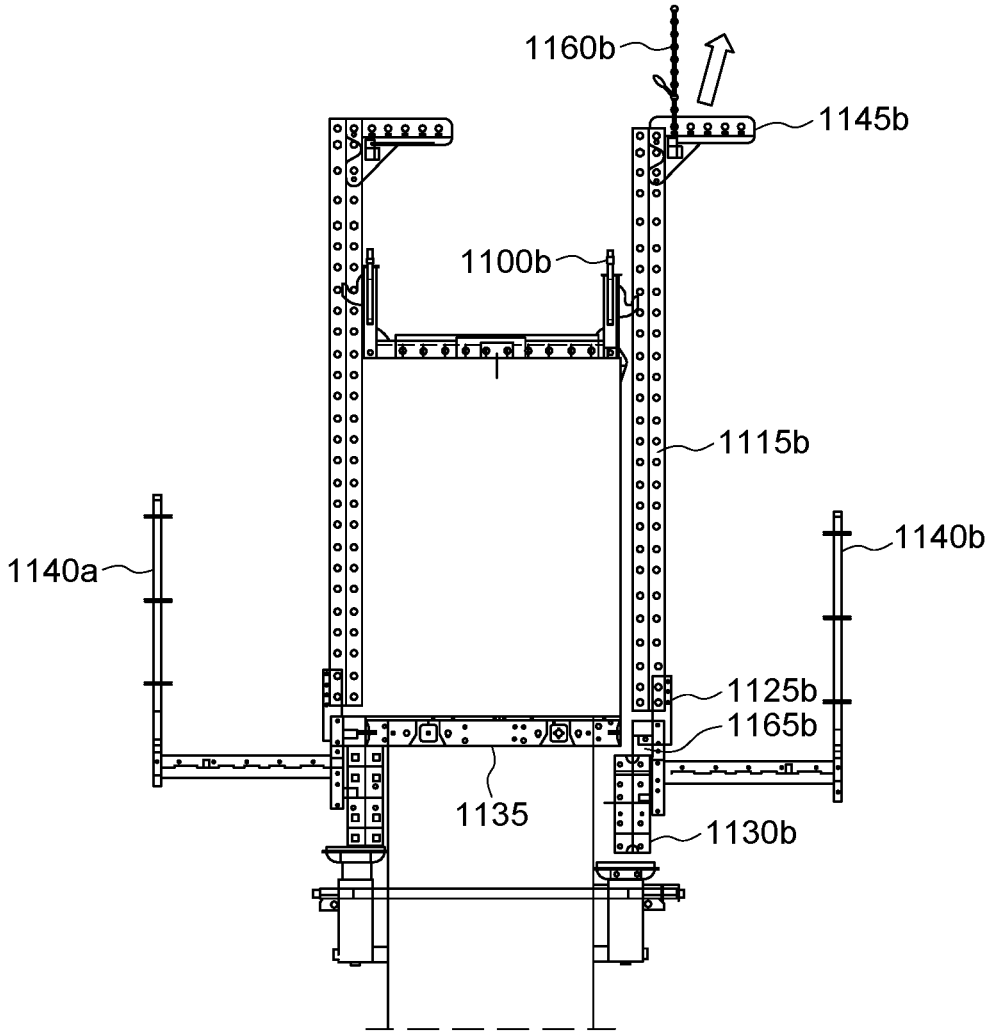

At shown in FIG. 11D, the chain 1160*b* has attached to an attachment hole of the gallows 1145*b*, with the chain 1160*b* being lifted by a crane (not shown). The construction element 1115*b* and the load (e.g., 1130*b*, 1165*b*, 1140*b*) can be lifted by the crane, with the particular attachment hole of the gallows 1145*b* for engagement being selected according to a center of gravity of the construction element 1115*b* and load (e.g., 1130*b*, 1165*b*, 1140*b*).

Figure 11E:
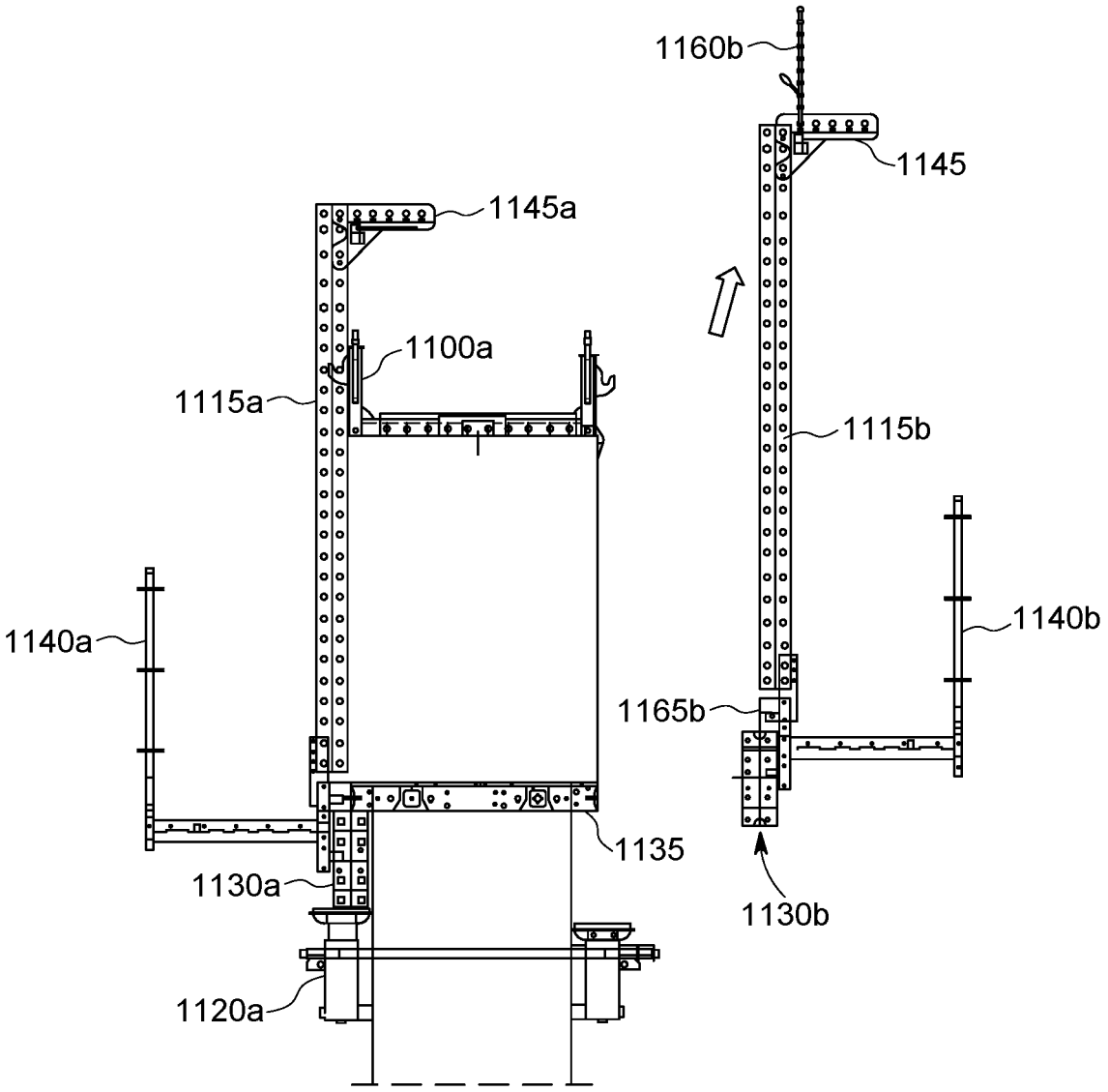

As shown in FIG. 11E, the construction element 1115*b* and load (e.g., 1130*b*, 1165*b*, and 1140*b*) are removed.

Figure 11F:
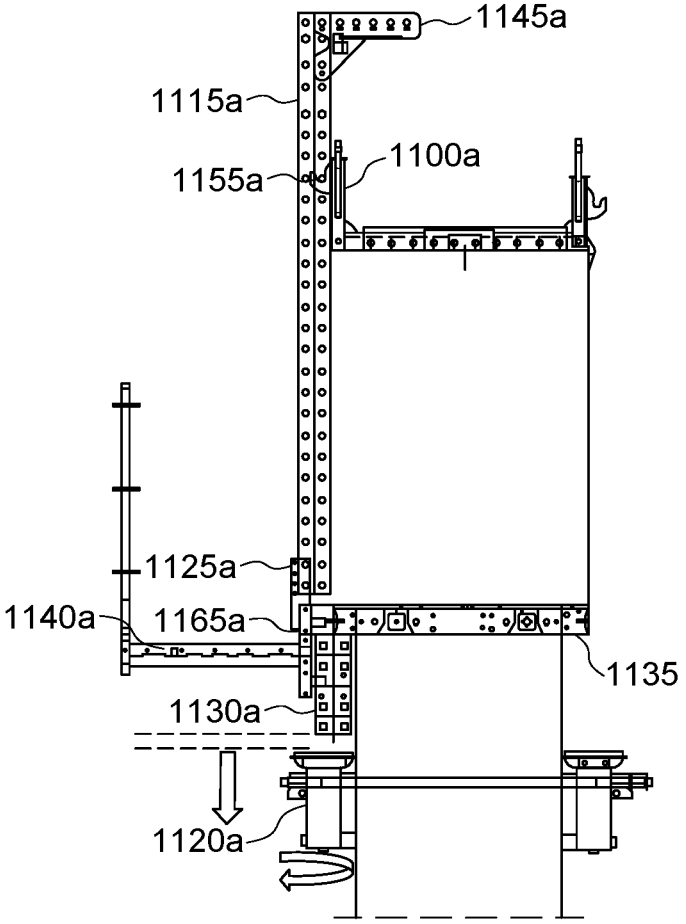

As shown in FIG. 11F, the jack 1120*a* is lowered.

Figure 11G:
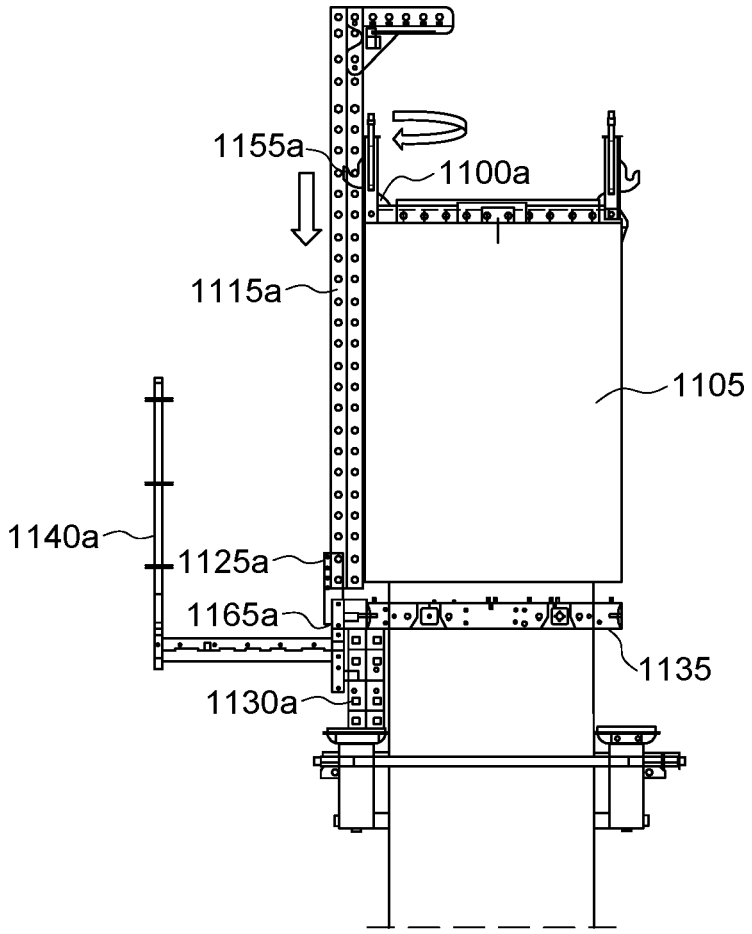

As shown in FIG. 11G, the other striking element 1100*a* is activated (e.g., by rotation of an attachment point) such that the hook 1155*a* lowers and the construction element 1115*a* and associated load (1130*a*, 1135, 1165*a*, 1140*a*) are lowered as one assembly, including the horizontal formwork 1135. Here, the horizontal formwork 1135 is lower vertically relative to the concrete section 1105, and thus the horizontal formwork 1135 is removed or stricken (e.g., stripped) from the concrete section 1105.

Figure 11H:
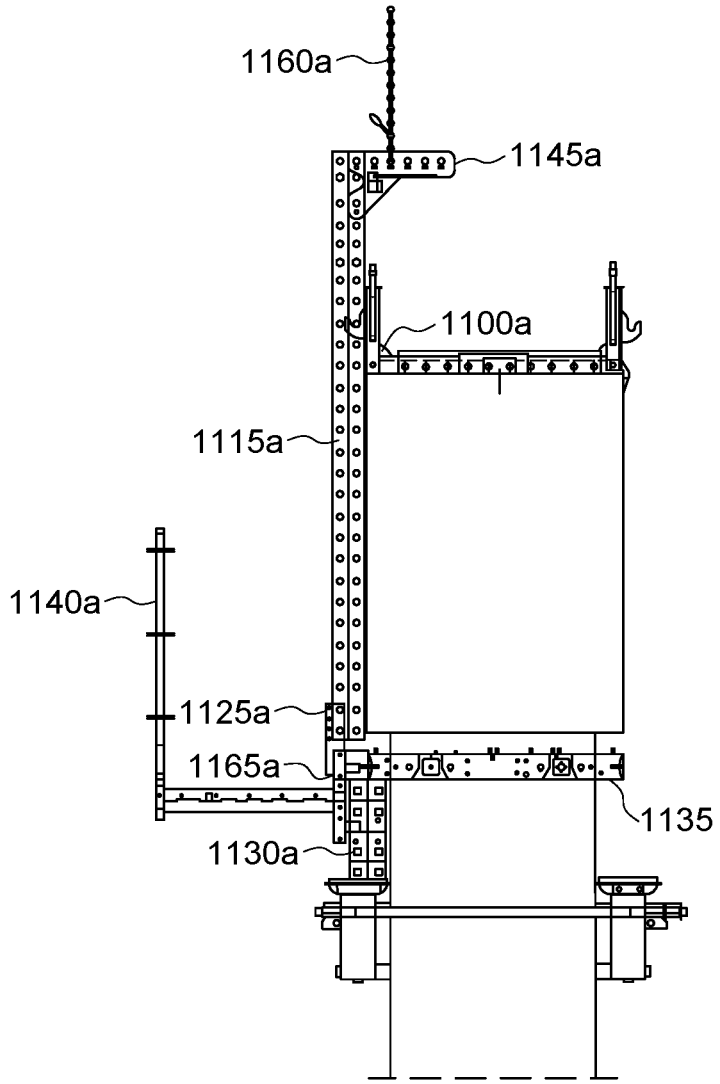

As shown in FIG. 11H, the chain 1160*a* is installed relative to an attachment hole of the gallows 1145*a* according to the center of gravity of the construction element 1115*a* and load (1130*a*, 1135, 1165*a*, 1140*a*).

Figure 11I:
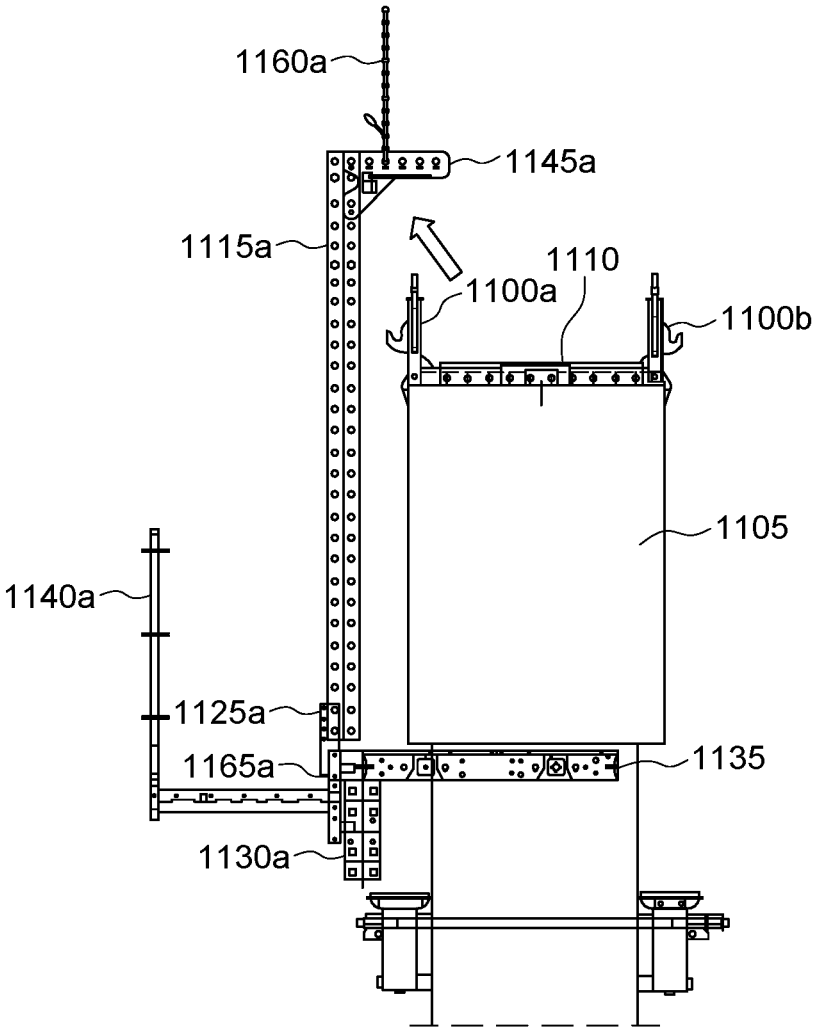

As shown in FIG. 11I, the construction element 1115*a* and load (1130*a*, 1135, 1165*a*, 1140*a*) are removed from the concrete section 1105. Once removed, the striking elements 1100*a, b* and waler assembly 1110 can be removed from the concrete section 1105.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, the striking element described above can incorporate a hydraulic assembly that allows for raising or lowering of the hook. In this regard, activation of the hydraulic cylinder can cause vertical motion of the hook and thus a construction element and/or load associated therewith. Accordingly, this description is meant to be taken only by way of example, and not to otherwise limit the scope of this invention.

What is claimed is:

1. A striking element for striking at least one construction component from a concrete section, comprising:

an anchor section defining a horizontally extending first longitudinal axis and positionable relative to a portion of the concrete section;

a support section configured to support a load of a construction element, the support section configured to vertically lower the construction element; and a waler assembly that removably engages with the anchor section, the waler assembly being movable relative to the anchor section along the horizontally extending first longitudinal axis.

2. The striking element of claim 1, wherein the support section is configured to support a load associated with the construction element, the load comprising the at least one construction component.

3. The striking element of claim 2, wherein the at least one construction component comprises at least one or more of a main beam, a coupling beam, a platform, or a horizontal formwork.

4. The striking element of claim 1, wherein the construction element comprises at least one of a beam, a formwork element, a formwork panel, or a pipe.

5. The striking element of claim 1, wherein the anchor section defines an anchor section longitudinal axis and the support section defines a support section longitudinal axis such that the anchor section longitudinal axis and the support section longitudinal axis are orthogonal.

6. The striking element of claim 5, wherein the anchor section longitudinal axis is arranged horizontally in use and the support section longitudinal axis is arranged vertically in use.

7. The striking element of claim 1, wherein the support section comprises a hook configured to engage with the construction element.

8. The striking element of claim 7, wherein rotation of an attachment point on the support section that causes rotation of a threaded rod housed inside the support section thus causes the vertical movement of an internally threaded sleeve and the hook relative to the anchor section.

9. The striking element of claim 7, wherein activation of a hydraulic cylinder causes the vertical lowering of the construction element.

10. The striking element of claim 8, wherein the attachment point comprises a hexagonal cross section and is capable of being engaged by a tool.

11. The striking element of claim 1, wherein the support section comprises an extension that is configured to extend vertically downwards at a side portion of the concrete section.

12. The striking element of claim 1, wherein the waler assembly defines a first plurality of waler holes arranged to align with a first plurality of anchor holes defined by the anchor section, such that a pin is insertable into one of the first plurality of walers holes and a corresponding one of the first plurality of anchor holes to fix and align the waler assembly relative to the anchor section.

13. The striking element of claim 1, wherein the waler assembly defines a second plurality of waler holes arranged to align with a second plurality of anchor holes defined by the anchor section, such that a wedge is insertable into one of the second plurality of waler holes and a corresponding one of the second plurality of anchor holes to fix and align the waler assembly relative to the anchor section in a stepless manner.

14. The striking element of claim 12, wherein the waler assembly is engaged with the portion of the concrete section by an anchor assembly comprising at least one of: a tie-rod, a screw, a bolt, or a dowel.

15. The striking element of claim 1, wherein the portion of the concrete section comprises a top portion, and the anchor section is bolted to the top portion of the concrete section.

16. The striking element of claim 1, wherein the support section further comprises:

an elastic element configured to support the construction element and the load associated with the construction element and provide visual feedback indicative of the load associated with the construction element.

17. The striking element of claim 16, wherein the elastic element comprises at least one of a spring or a rubber buffer.

18. The striking element of claim 16, wherein the elastic element is located between a top surface of the support section and the attachment point so that the attachment point is distanced from the top surface of the support section by a predetermined distance corresponding to at least a height of the elastic element.

19. The striking element of claim 16, wherein the support section further comprises:

a sleeve indicative of whether an elastic element is installed incorrectly, the elastic element is not installed, or the elastic element has failed.

20. The striking element of claim 19, wherein the sleeve is located between a top surface of the support section and the attachment point so that the attachment point is distanced from the top surface of the support section by a predetermined distance corresponding to at least a height of the sleeve.

21. An assembly, comprising:

a construction element arranged relative to a concrete section;

a first striking element positioned relative to a portion of the concrete section and configured to strike a construction component from the concrete section, the first striking element comprising:

a first anchor section positionable relative to a portion of the concrete section; and a first support section configured to support a load of the construction element, the first support section configured to vertically lower the construction element;

a second striking element positioned relative to an opposing portion of the concrete section such that a first anchor section longitudinal axis of the first anchor section of the first striking element is coaxial with a second anchor section longitudinal axis of a second anchor section of the second striking element; and a waler assembly removably engageable with the first striking element and the second striking element.

22. The assembly of claim 21, wherein the construction element comprises a beam arranged essentially vertically and the load associated with the construction element comprises a horizontal formwork arranged essentially transversely to the beam.

23. The assembly of claim 21, further comprising:

a first extension element on the first support section of the striking element; and a second extension element on a second support section of the second striking element, wherein the waler assembly, the first extension element, and the second extension element cooperate to align the striking element and the second striking element relative to the concrete section.

24. The assembly of claim 21, wherein the waler assembly is engaged with the portion of the concrete section by an anchor assembly comprising at least one of: a tie-rod, a screw, a bolt, or a dowel.

25. The assembly of claim 21, wherein the first anchor section and the second anchor section are not directly fixed to the concrete section.

26. The assembly of claim 21, further comprising:

one or more prop elements positioned atop the portion of the concrete section and configured to support at least one of the anchor section of the striking element and a second anchor section of the second striking element.

27. The assembly of claim 21, further comprising:

an anchor assembly configured to fix the waler assembly relative to the concrete section.

28. The assembly of claim 21, wherein the waler assembly defines a first plurality of holes arranged to align with a plurality of holes defined by the anchor section, such that a pin is insertable into one of the first plurality of holes and a corresponding one of the plurality of holes to fix and align the waler assembly relative to the anchor section.

29. The assembly of claim 21, wherein the waler assembly defines a second plurality of holes configured to receive a plurality of wedges to provide alignment of the anchor section and the waler assembly in a stepless manner.

* * * * *